US007607564B2

(12) United States Patent
Churvis et al.

(10) Patent No.: US 7,607,564 B2
(45) Date of Patent: Oct. 27, 2009

(54) RIGID CORRUGATED BULK CONTAINER FOR LIQUIDS AND SEMI-LIQUID FLUIDS

(75) Inventors: Michael Churvis, Germantown, TN (US); Lawrence A. Gates, Germantown, TN (US); William F. Moss, Canonsburg, PA (US); Pamela Jean Riggins, Bartlett, TN (US)

(73) Assignee: International Paper Co., Memphis, TN (US)

( * ) Notice: Subject to any disclaimer, the term of this patent is extended or adjusted under 35 U.S.C. 154(b) by 667 days.

(21) Appl. No.: 10/867,570

(22) Filed: Jun. 14, 2004

(65) Prior Publication Data

US 2005/0040063 A1 Feb. 24, 2005

Related U.S. Application Data

(60) Provisional application No. 60/492,524, filed on Aug. 5, 2003.

(51) Int. Cl.
*B65D 19/00* (2006.01)

(52) U.S. Cl. ..... 229/117.3; 229/122.3; 229/227; 206/386

(58) Field of Classification Search ..... 229/117.35, 229/122.33, 122.21, 122.27, 122.3, 122.32, 229/240, 227, 226, 238, 239, 129; 220/495.05, 220/495.06, 495.01, 23.91, 601; 206/386, 206/600; 222/105, 183
See application file for complete search history.

(56) References Cited

U.S. PATENT DOCUMENTS 3,136,473 A 6/1964 Kieffer
3,285,496 A * 11/1966 Barnhardt, Sr. et al. ..... 229/211
3,349,986 A 10/1967 Chapman et al.
3,363,807 A 1/1968 Powell
4,380,314 A 4/1983 Langston, Jr. et al.
4,426,015 A * 1/1984 Preston et al. ..... 229/117.28
4,666,059 A 5/1987 Nordstrom
4,771,917 A 9/1988 Heaps, Jr. et al.
4,793,519 A 12/1988 Voorhies, Jr.
4,850,506 A 7/1989 Heaps, Jr. et al.
4,886,164 A 12/1989 Stein et al.

(Continued)

*Primary Examiner*—Nathan J Newhouse
*Assistant Examiner*—Christopher Demeree
(74) *Attorney, Agent, or Firm*—Matthew M. Eslami; Thomas W. Barnes, III

(57) ABSTRACT

A corrugated bulk container for shipping, storing and dispensing liquids and semi-liquid fluids. The container is a laminated triple wall open-ended tube having side walls and end walls, and a bag assembly is supported in the tube for containing the liquid or semi-liquid fluid. The bag assembly includes a bag having a fill valve and a dispensing valve attached to it, a bag cassette to which a bottom end of the bag is attached, and a fill valve support plate to which a top end of the bag is attached. The bag cassette has structure to receive and hold the dispensing valve in position relative to a dispensing valve opening in the tube, and the fill valve support plate has structure to receive and support the fill valve. The container is attached to a pallet by severable structure, and the fill valve support plate is attached to the tube by severable structure so that the bag assembly can be removed from the container, for easy collapse of the container for disposal or recycling. Fill valve support structure is cut from the fill valve support plate and folded into a position to receive and support the fill valve.

40 Claims, 20 Drawing Sheets

U.S. PATENT DOCUMENTS 4,930,661 A * 6/1990 Voorhies ..... 206/386
5,018,877 A 5/1991 Kantz
5,050,775 A 9/1991 Marquardt
5,069,359 A 12/1991 Liebel
5,294,040 A 3/1994 Cohen et al.
5,348,186 A 9/1994 Baker
5,351,849 A 10/1994 Jagenburg et al.
5,353,982 A 10/1994 Perkins et al.
5,356,029 A 10/1994 Hogan
5,803,346 A 9/1998 Baker et al.
6,223,903 B1 5/2001 Mansouri
6,360,907 B1 * 3/2002 Przytulla ..... 220/23.91
6,520,403 B1 2/2003 Lapoint, III
6,637,623 B2 * 10/2003 Muise et al. ..... 222/105
6,755,324 B2 * 6/2004 Geshay ..... 222/1
2002/0148885 A1 10/2002 Prince
2003/0106927 A1 6/2003 Bryant et al.
2003/0132275 A1 7/2003 Ingalls
2003/0160092 A1 8/2003 Philips et al.
2005/0023330 A1 2/2005 Cook et al.
2005/0051611 A1 3/2005 Ingalls

* cited by examiner

RIGID CORRUGATED BULK CONTAINER FOR LIQUIDS AND SEMI-LIQUID FLUIDS

This application claims the benefit of U.S. provisional patent application Ser. No. 60/492,524, filed Aug. 5, 2004.

FIELD OF THE INVENTION

This invention relates generally to packaging for shipping and storing bulk quantities of product. In particular, the invention relates to a packaging system for shipping, storing and dispensing liquid or semi-liquid fluids, and more specifically to a corrugated container and supported bag that are fully assembled and ready to use, thereby enabling a user to fill the bag without first having to assemble part or all of the container, and wherein the container can be easily collapsed and disposed of when it is empty.

BACKGROUND ART

Conventional containers for use in shipping, storing and dispensing liquid or semi-liquid fluids often consist of either "bottle and cage" arrangements, or composite corrugated containers. The "bottle and cage" arrangements comprise a semi-rigid plastic bottle that is supported within a wire-bound exterior skeleton. This configuration requires the end user to utilize significant warehouse space to store the spent container until it can be returned to a distributor to be cleaned and reconditioned for reuse. The composite corrugated containers are intended for one-time use, and support a flexible interior bag. These containers require an initial user to assemble the container as well as an assortment of fitments that include a corrugated cassette that holds the bag and positions it for filling, and a corrugated cap that is assembled and placed on top of the container subsequent to filling. Further, the initial user often must then physically attach the assembled corrugated composite container to a wood pallet that is used as a base for the container. Attaching the pallet usually requires about four heavy-duty plastic straps that wrap around both the pallet and the container to hold them together. These parts all require the filler to inventory and keep track of the various components, as well as to provide the manpower and space necessary to assemble them. Another disadvantage of these prior art systems is the need for the filler to reach into the bottom of the package, which can be 35 inches or more deep, in order to attach the fill valve mechanism through which the bag is filled.

A need therefore exists for an affordable, functional bulk container for liquids and semi-liquid fluids, that can be purchased as a fully assembled ready to fill unit, and that can be easily collapsed for disposal or recycling.

DISCLOSURE OF THE INVENTION

The present invention is an economical corrugated bulk container that can be purchased as a fully assembled, ready to fill unit for shipping, storing and dispensing liquids or semi-liquid fluids, that can be filled using an automated tote or drum filling station, and that can be easily collapsed and disposed of by an end user after use.

The container of the invention comprises a triple wall laminated tube having two length panels and two width panels defining a container side wall, with a dispensing valve opening provided in one of the width panels. This construction provides superior bulge resistance and stacking strength. Top and bottom end caps are placed on the ends of the tubular side wall. The caps are preferably laminated to the sidewalls of the tube, and serve the function of "squaring up" the tube. Thus, utilizing an interior cassette as a squaring device is not required. Affixed top and bottom caps also help to minimize bulge.

A unitary bag assembly is supported in the container, and comprises a flexible bag fixed at its lower end to a bag cassette and at its upper end to a fill valve support plate. The bag has a fill valve attached to its upper end, and a dispensing valve attached to its lower end. The bag cassette positions and supports the dispensing valve in the bottom of the container, and also provides additional score lines along the bottom cap and the bottom of the tube for support where most of the weight of the bag is concentrated. The fill valve support plate securely positions and supports the fill valve in the top of the container, with the bag held in a generally expanded condition between the cassette and the fill valve support plate.

The container is secured to a pallet by attaching the bottom cap to the pallet, thereby eliminating the need for separate straps to secure the container to a pallet. Both end caps have readily separable portions to enable the bag assembly to be easily removed from the container, and to enable the container to be quickly and easily separated from the pallet and collapsed for disposal or recycling.

The fill valve support plate may be releasably attached to the top cap to provide a tamper evident means, and one or more insert panels may be placed in the tube against the inner surface of the side wall to enhance the bulge resistance and stacking strength of the container.

In a first embodiment, the bag cassette comprises a generally flat, rectangular bottom wall, with upstanding flanges around its perimeter adapted to fit closely within the container side walls. The bottom of the bag is glued or otherwise suitably affixed to the top surface of the cassette. The cassette serves to support the bottom of the bag and to position and align the dispensing valve with the dispensing valve opening in the container side wall. The fill valve support plate secures and locates the fill valve along the top plane of the assembled container, and has a filling hole cut out of a region that is aligned with the location of the fill valve. A multiplicity of die cut flaps flank the filling hole. Each flap has a fastening hoop that serves to secure the fill valve to the fill valve support plate, which in turn holds the bag in an upward, fillable position. This is achieved by first bending the die cut flaps 180 degrees toward the interior of the container. The filling valve is then inserted through the filling hole and fastening hoops, slightly flexing the hoop along the hoop's ridged edges as it passes through. The hoop then re-sizes along the back end of the filling valve, thereby holding it in place. This feature eliminates the need for the initial user to pull up the filling valve from the bottom of the assembled container, thereby dramatically increasing the ease and efficiency of a filling operation. The fill valve support plate is attached to the upper end of the container side wall by foldable flaps on the periphery of the plate, and tear tape in the flaps adjacent their folded connection with the plate enables the flaps to be severed so that the fill valve support plate, bag, and bag cassette can be easily removed from the container. In this regard, the fill valve support plate can comprise one piece, with a flap on each of its four sides, or it can comprise two pieces laminated together, with each piece having flaps only on two opposite sides, and the two pieces oriented with respect to one another so that the composite has flaps on all four sides. The two pieces can be sucured together by any suitable means, including adhesive, double face tape, or thumb locks (shown in the corners of the two pieces in FIG. 14).

In a preferred embodiment, the bag cassette also comprises a generally flat, rectangular bottom wall, with upstanding flanges around its perimeter adapted to fit closely within the container side walls. As in the first embodiment, one of the upstanding flanges has a cut-out in it through which the dispensing valve is inserted. Bendable tabs surrounding the opening flex when the dispensing valve is inserted through the opening, and engage behind the valve to prevent its withdrawal back through the opening. A panel on the upper edge of the flange is folded outwardly and downwardly to lie generally parallel with the outer surface of the flange, and a cut-out in the free edge of the panel engages against the dispensing valve to help secure it in position. Locking tabs and recesses on the flange and panel interengage to hold the panel in its operative folded position. With this arrangement the bag cassette serves to positively hold and support the dispensing valve, and locate it relative to the dispensing valve opening in the container side wall.

Further, the fill valve support means in the preferred embodiment is much stronger than in the first embodiment, and supports the fill valve in a protected recessed position at the top of the container. Additionally, elastic bands are connected between the bag and the fill valve support plate to help support the bag in a generally expanded condition ready to be filled.

In the preferred embodiment, a series of cuts are made in the fill valve support plate, defining a rectangularly-shaped frangible tear line extending around and forming a detachable rectangularly-shaped panel that has a central opening therethrough in a position to be aligned with the fill valve attached to the bag when the parts are in their operative positions. Shaped cut-outs are formed through the fill valve support plate spaced outwardly from three sides of the detachable panel, and a series of cuts made in the fill valve support plate spaced outwardly from the fourth side of the detachable panel form a fill valve support structure that is foldable over and into the rectangular opening left when the detachable panel is removed.

The fill valve support structure essentially has four bendable arms radiating outwardly from a rectangular support panel, with bendable locking tabs on the outer ends of three of the arms and the fourth arm comprising a web connecting the support panel to the fill valve support plate at said fourth side of the detachable panel. A central opening is formed through the support panel in a position adapted to be aligned with the fill valve when the container is. erected and the fill valve support structure is in its operative folded position in the rectangular opening. A plurality of bendable tabs extend around the perimeter of the central opening to engage behind the fill valve and prevent its withdrawal through the opening after the fill valve is inserted through it.

When the fill valve support structure is in its operative position, the support panel is supported by the arms in a horizontal position recessed in the rectangular opening below the plane of the fill valve support plate, and the locking tabs on the outer ends of said three arms are engaged in the cut-outs spaced outwardly from said three sides of the rectangular opening, essentially suspending or hanging the support panel from the fill valve support plate. The detachable panel, having been removed prior to insertion of the support panel into the opening, is replaced so that it lies on top of the support panel and wedges against the arms to secure the components in their operative position. A central opening in the detachable panel is aligned with the opening through the support panel, and the fill valve also extends through this opening. Bendable tabs around the opening in the detachable panel engage behind the fill valve to prevent withdrawal of the valve through the opening and also to prevent removal of the detachable panel after it is operatively positioned.

To erect a container according to the invention, insert panels, if used, are inserted into the tube and spot glued to the inner surface of the tube side walls. A bottom end cap is then secured to the bottom end of the tube by use of double face tape or adhesive, and the assembled tube and bottom cap are secured to the top of a pallet by use of an adhesive or other suitable fastening means between the bottom cap and pallet. The bottom cap also serves to square up the tube side wall.

The bag assembly is erected as follows:

(1) The dispensing valve on a bag previously attached to the cassette is inserted through the opening in said one flange of the cassette, and the panel on the upper edge of the flange is then folded over so that the recess in its free edge is engaged behind the dispensing valve. The locking tabs and recesses on the flange and panel are then engaged to hold the panel and flange in their operative folded position, with the dispensing valve securely held in the opening through the flange.

(2) The fill valve support plate is prepared by first removing the detachable panel and then folding the fill valve support structure over and pushing the support panel down through the opening left by removal of the detachable panel. The upper ends of the arms are then folded outwardly and downwardly and the locking tabs on the outer ends of the arms are pressed through the cut-outs spaced outwardly from the opening, so that the support panel is suspended below the rectangular opening.

(3) The assembled fill valve support plate is then positioned over the previously assembled bag and bag cassette, with the opening in the recessed support panel aligned with the fill valve on the bag. The fill valve is inserted through the opening until the bendable tabs around the opening engage behind the fill valve. The previously removed detachable panel is then placed down over the recessed support panel, until it lies flat against the support panel and the bendable tabs around the opening in the detachable panel are engaged behind the fill valve, thus locking the detachable panel in place wedged against the arms and preventing movement of the support panel back up through the rectangular opening. At this point, the bag assembly, comprising the bag, bag cassette, and fill valve support plate is ready to be placed in the container.

The bag assembly is positioned over the open top end of the tubular side wall, with the cassette beneath the fill valve support plate. The cassette is then fitted inside the upper end of the container and permitted to fall down into the container, with the fill valve support plate supported on the upper end of the container, whereby the bag partially expands or unfolds to extend between the cassette and the fill valve support plate. The user then lifts an edge of the fill valve support plate and reaches into the container and grasps an elastic band previously attached to the bag at each of four spaced locations on the bag corresponding to the locations of the comers of the container. One end of each elastic band is fed upwardly through a small hole formed near each respective corner of the fill valve support plate, and the band is then stretched over an arrow-shaped projection formed in the plane of the fill valve support plate by a pair of intersecting cuts extending from their point of intersection toward respective adjacent side edges of the fill valve support plate. Upon release of the elastic band it remains engaged on the arrow-shaped projection and stretched through the associated hole to the associated connection with the bag, thus holding the bag in a further expanded condition ready to be filled, and helping to support the bag.

A flap on each of the four side edges of the fill valve support plate is then folded downwardly against the outer surfaces of the top end of the side wall and secured thereto by use of double sided tape or adhesive. For example, a pressure sensitive adhesive may be placed on the inside surface of each flap, whereby it is necessary only to fold the flap down and apply pressure to it to laminate it to the upper end of the container side wall.

A top cap is then fitted on top of the container in overlying relationship to the fill valve support plate to complete erection of the container. The top cap covers the fill valve and its support structure, thus protecting it during handling and storage. The top cap also reinforces the top end of the container side wall and helps resist outward bulging of the side wall. An adhesive, or double face tape, or the like, may be placed between the top cap and the fill valve support plate to releasably attach them together until the container is to be filled, whereupon this attachment can be broken and the top cap removed to gain access to the fill valve. This feature also provides a tamper evident means.

After the container has been emptied it can be easily collapsed for disposal or recycling. To this end, a tear strip is provided near the folded connection of each flap on the fill valve support plate, and near the folded connection of each flap on the bottom cap. In this regard, it will be recalled that the flaps on the fill valve support plate and on the bottom cap are attached to the respective ends of the container side wall. A tear tab facilitates grasping of one end of each tear strip. When the flaps are severed from the fill valve support plate by pulling the tear strip, the fill valve support plate and attached bag and bag cassette may be lifted from the container. Similarly, when the flaps are severed from the bottom cap, the container may be separated from the pallet, whereupon the container may be easily collapsed for disposal or recycling. It will be noted that the flaps do not wrap around the comers of the container, but terminate short of the comers so that operation of the tear strips is easily achieved and results in complete separation of any means that would hold the parts together.

The corrugated container and supported bag of the invention can be purchased fully assembled and ready to use, thereby enabling a user to fill the bag without first having to assemble part or all of the container. Moreover, the container can be filled using an automated tote or drum filling station, and can be easily collapsed and disposed of when it is empty.

BRIEF DESCRIPTION OF THE DRAWINGS

The foregoing, as well as other objects and advantages of the invention, will become apparent from the following detailed description when taken in conjunction with the accompanying drawings, wherein like reference characters designate like parts throughout the several views, and wherein.

DETAILED DESCRIPTION OF THE PREFERRED EMBODIMENTS

Figure 1:
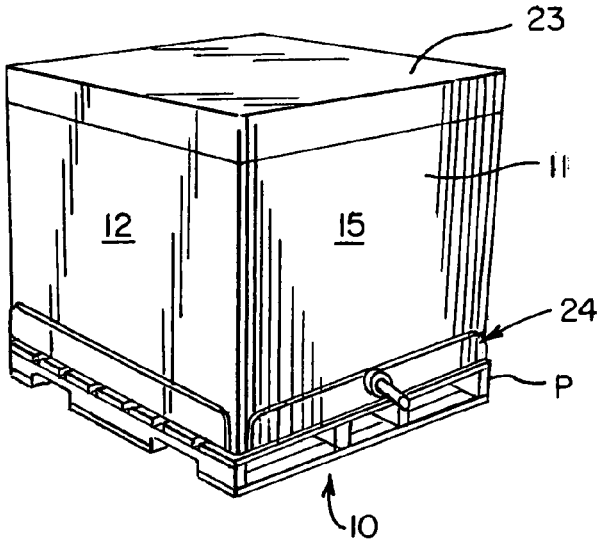
FIG. 1 is a top perspective view of a first form of bulk container according to the invention, showing the container fully assembled, attached to a pallet, with top and bottom end caps.
Figure 2:
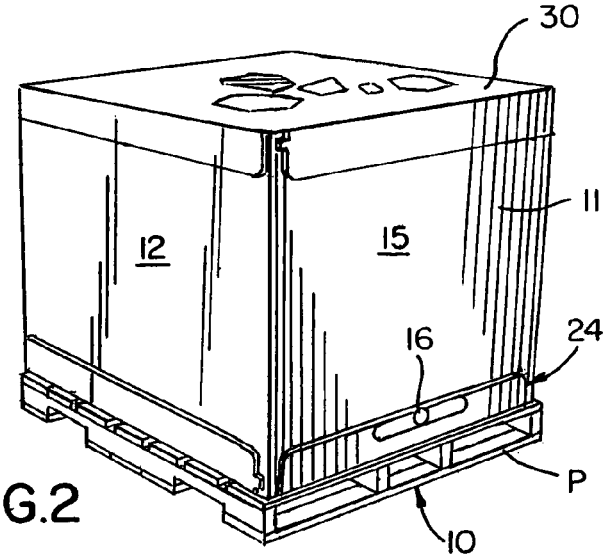
FIG. 2 is a slightly enlarged top perspective view of the container of FIG. 1, with the top cap removed for access to the fill valve.
Figure 3:
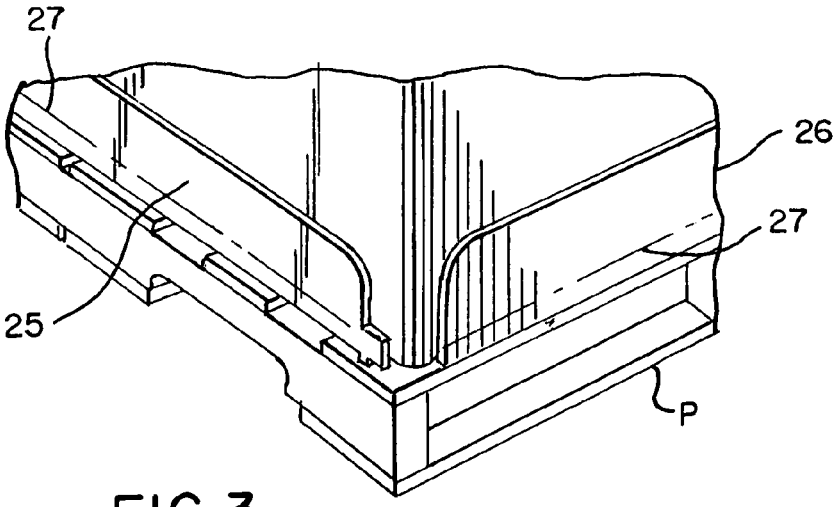
FIG. 3 is a further enlarged, fragmentary perspective view of a portion of a lower comer of the container of FIGS. 1 and 2, showing the tear tab and the cut out at the comer of the end cap that facilitates separation of the end cap and container when the tear tape is pulled to sever the end cap flange from the end wall.
Figure 7:
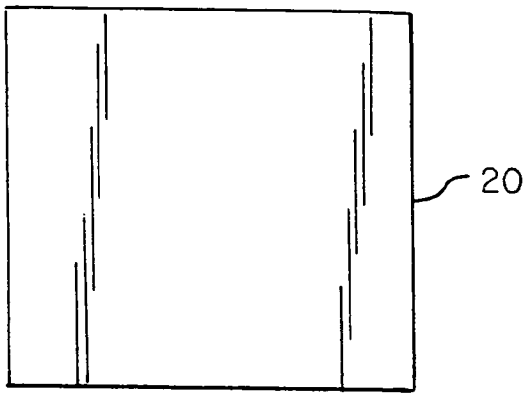
FIGS. 7, 8 and 9 are plan views of blanks for forming various inserts that may be used in the container of the invention to further reinforce the side wall and enhance bulge resistance and stacking strength.
Figure 9:
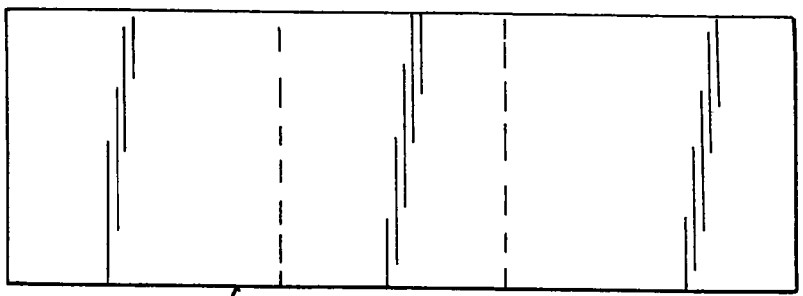
Figure 6:
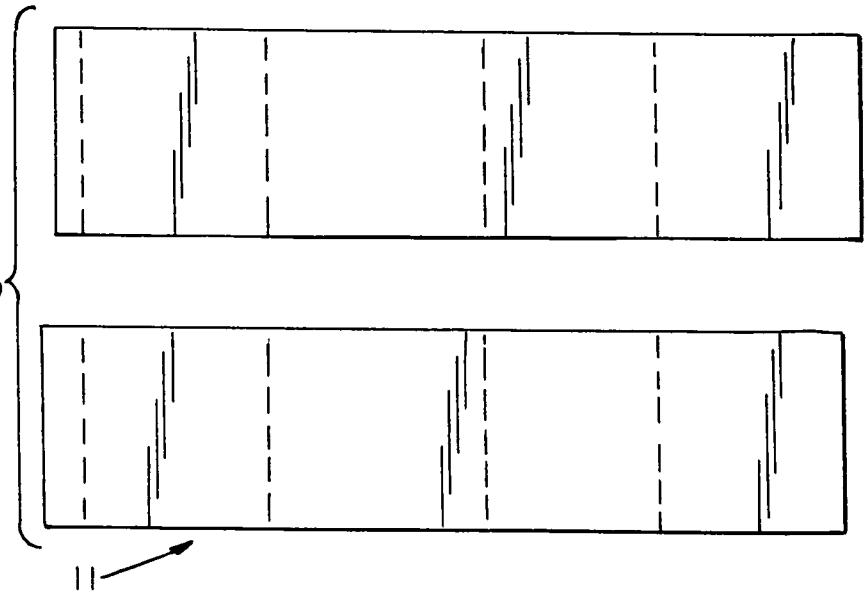
FIG. 6 is a plan view of the two triple wall corrugated blanks that are used in forming the side wall tube of the container of the invention.
Figure 8:
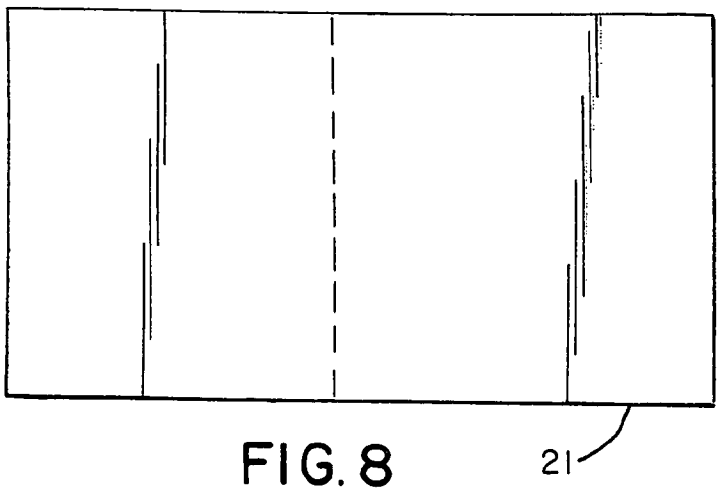
Figure 10:
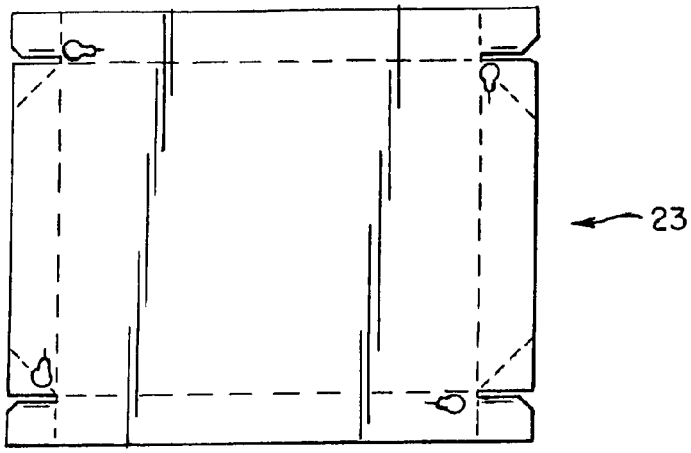
FIG. 10 is a plan view of a blank for making the top cap used on the container of the invention.
Figure 11:
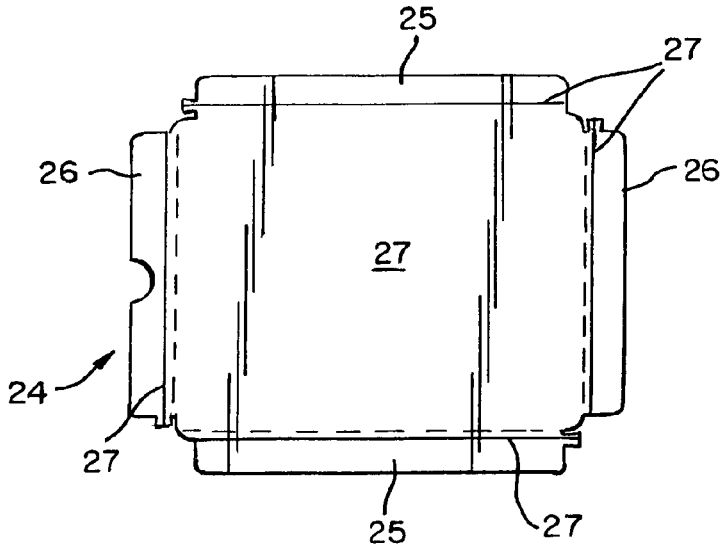
FIG. 11 is a plan view of a blank for making the bottom cap used on the container of the invention.
Figure 12:
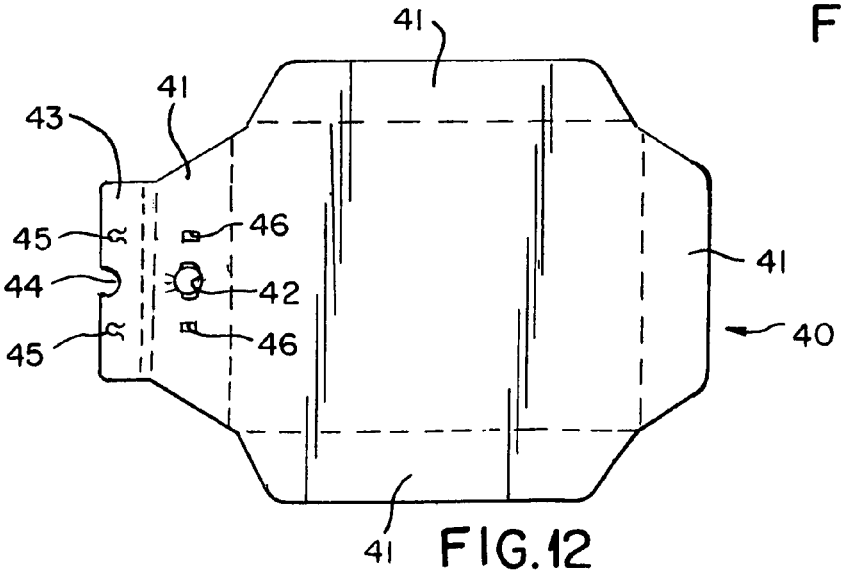
FIG. 12 is a plan view of a blank for making the bag cassette used in the container of the invention.
Figure 13:
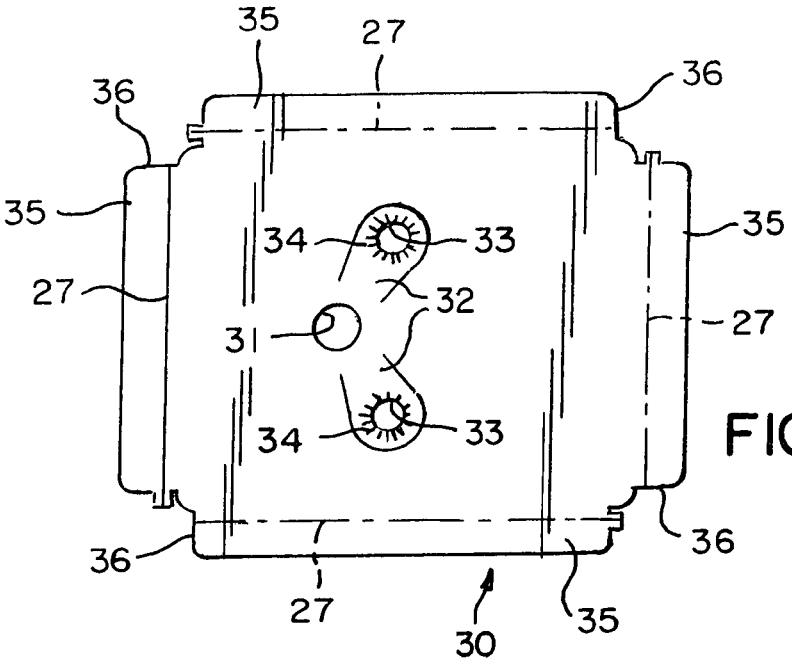
FIG. 13 is a plan view of a blank for making the inner top cap or fill valve support plate used in the container of the invention.
Figure 15:
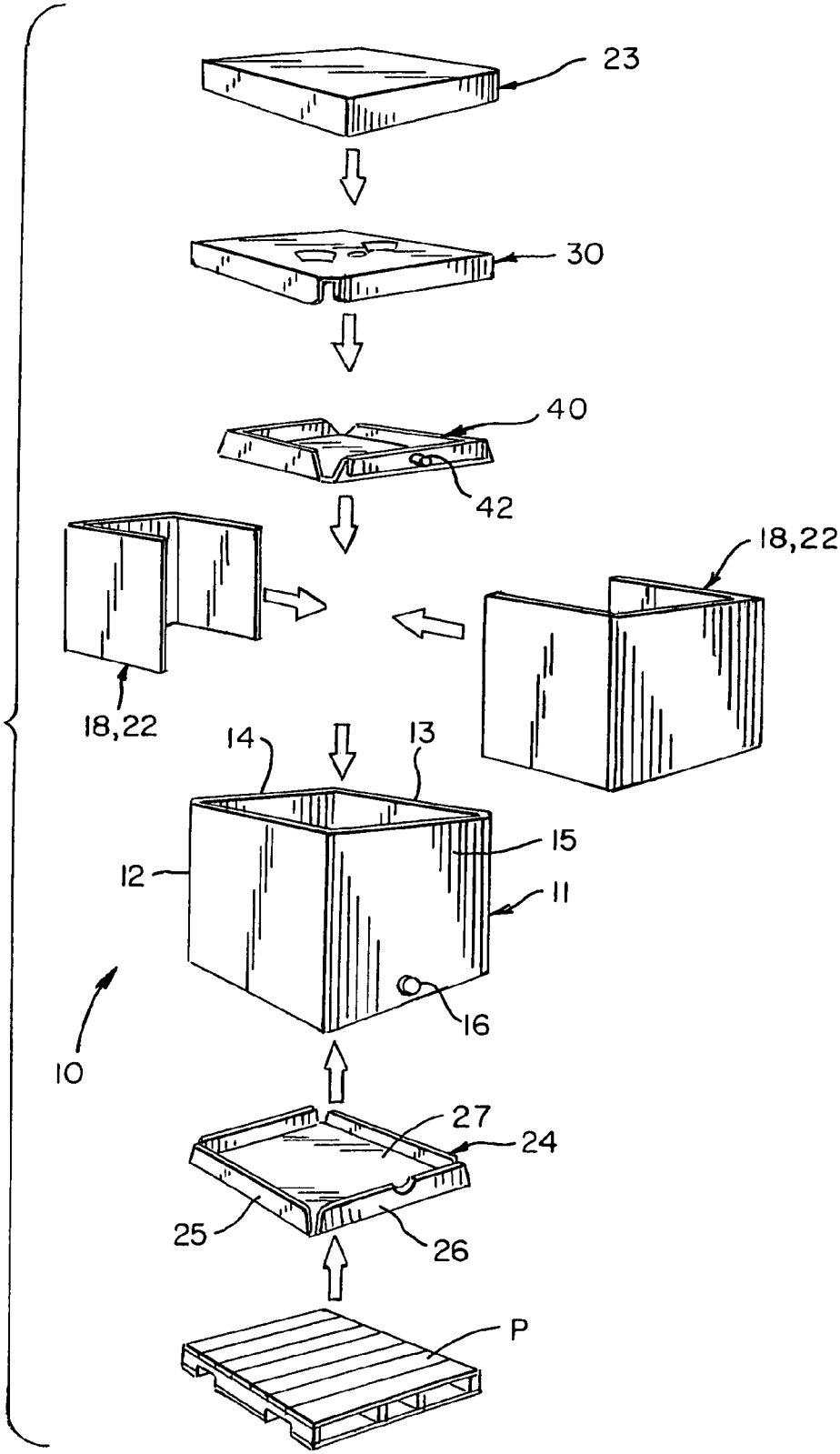
FIG. 15 is an exploded top perspective view of the components that form the container of the invention, with the bag being omitted for purpose of illustration.
Figure 17:
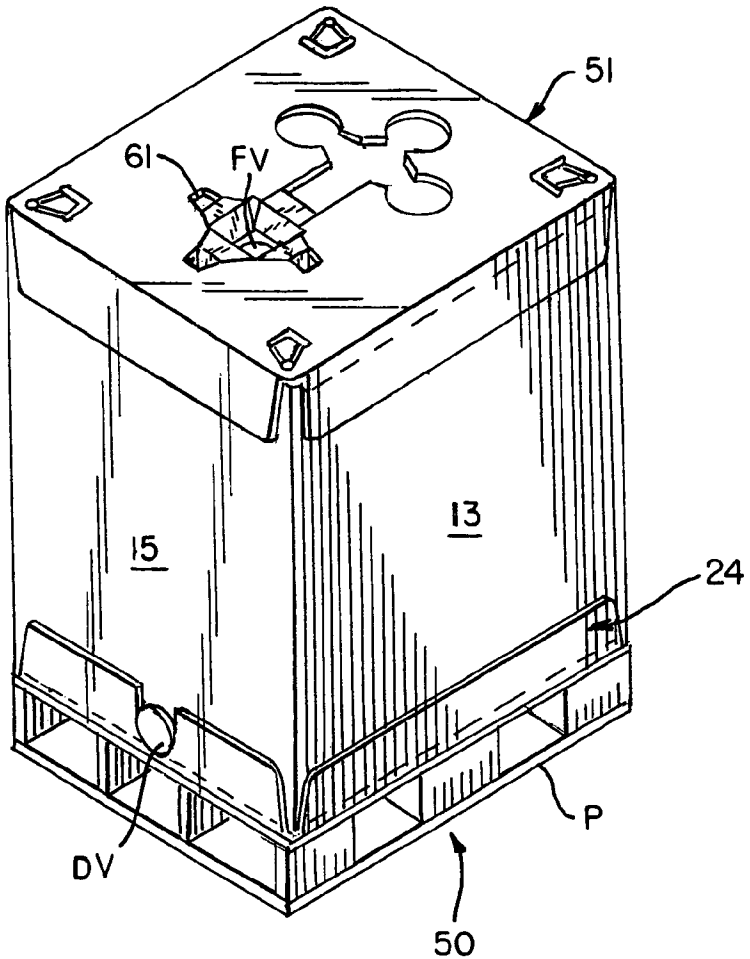
FIG. 17 is a top perspective view of the container of FIG. 16, with the top end cap removed to gain access to the fill valve.
Figure 16:
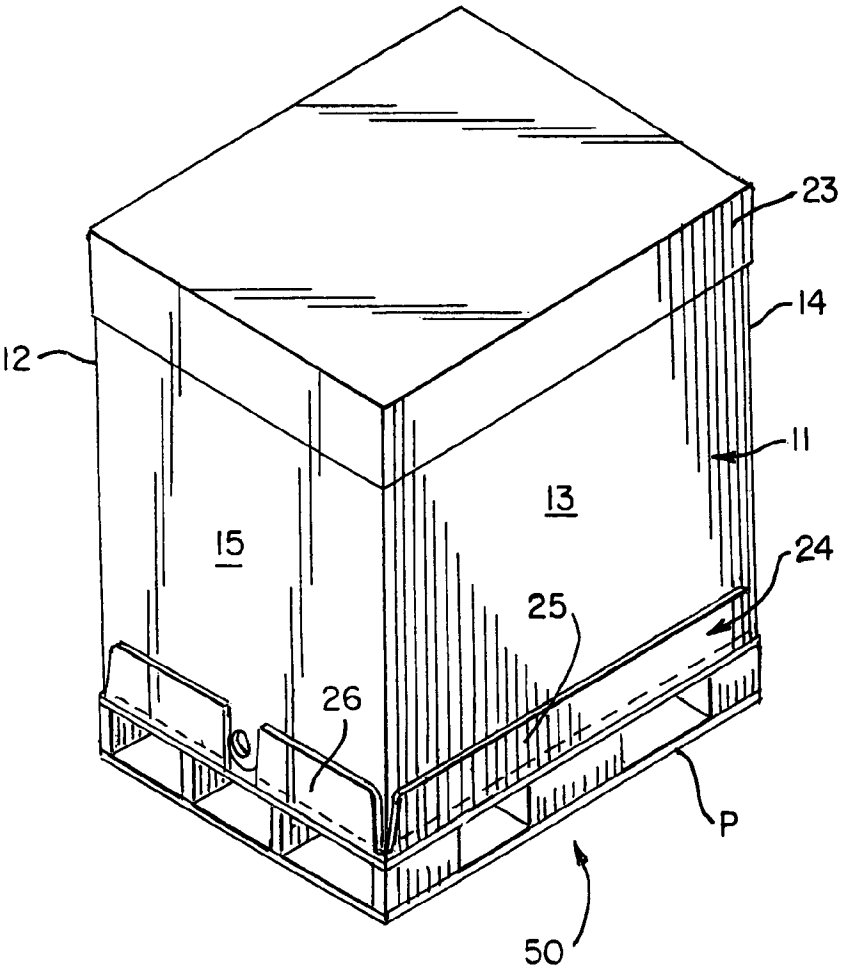
FIG. 16 is a top perspective view of a second and preferred form of container according to the invention, with the container shown fully assembled with top and bottom end caps and attached to a pallet.
Figure 18:
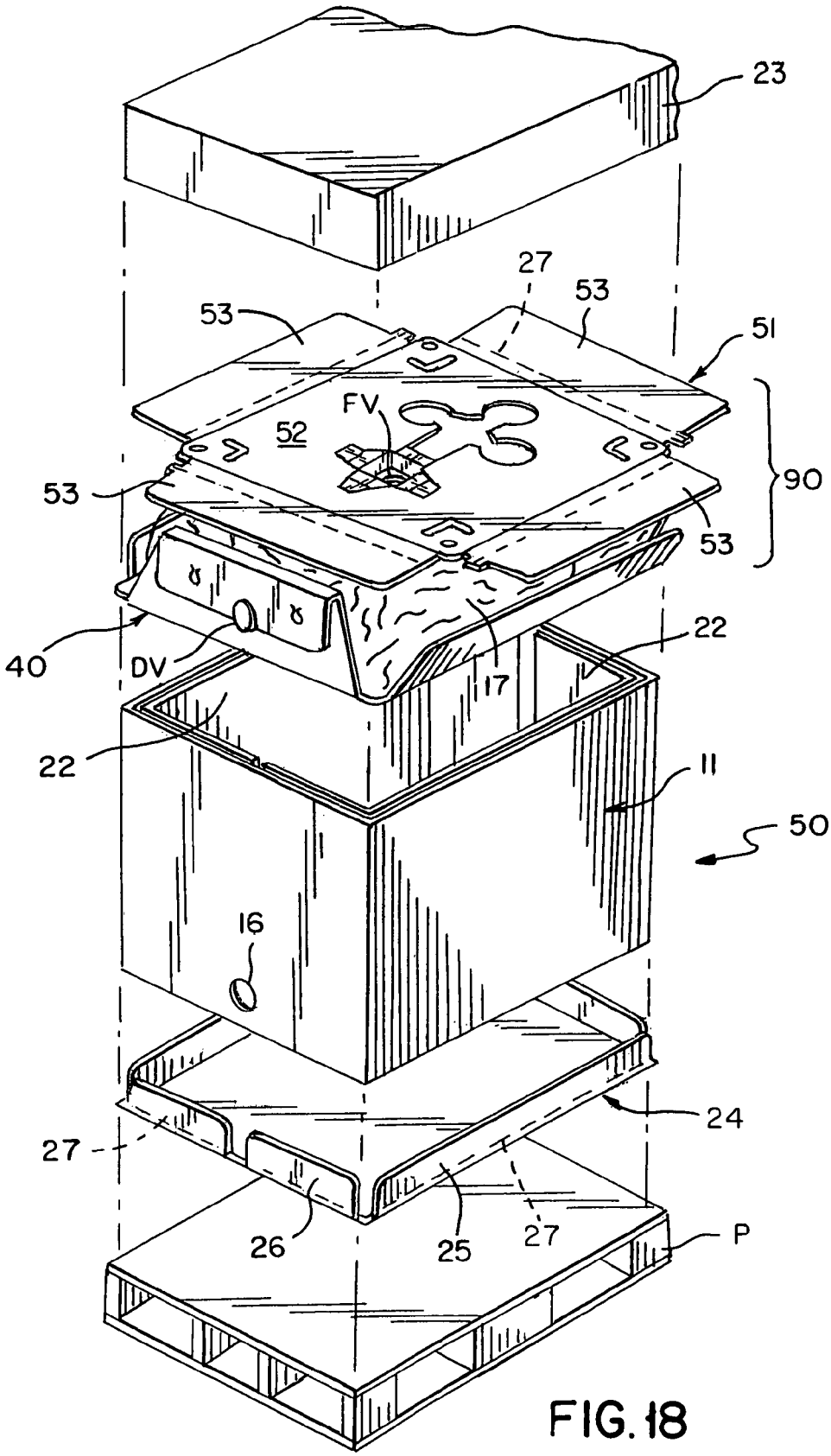
FIG. 18 is an exploded top perspective view of the container of FIG. 16, showing the pallet, top and bottom end caps, side wall tube with inserts, and bag assembly comprising the bag cassette, bag, and inner top cap or fill valve support plate.
Figure 19:
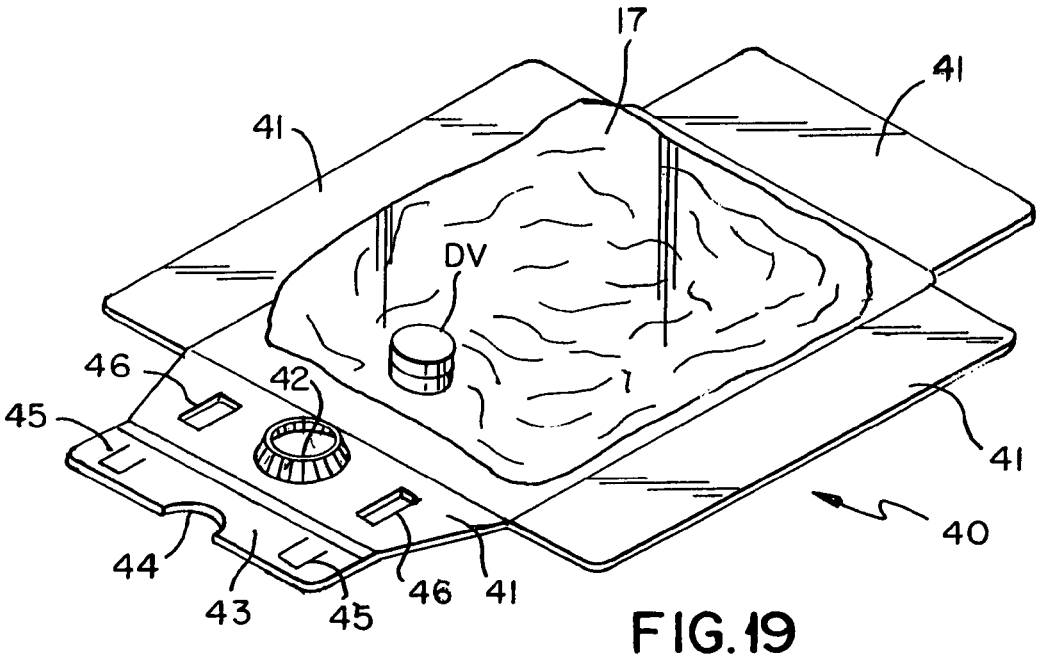
FIG. 19 is a top perspective view of the bag cassette of the preferred form of the invention, showing a bag affixed to the cassette but prior to folding and attachment of a cassette end wall with the dispensing valve on the bag.
Figure 20:
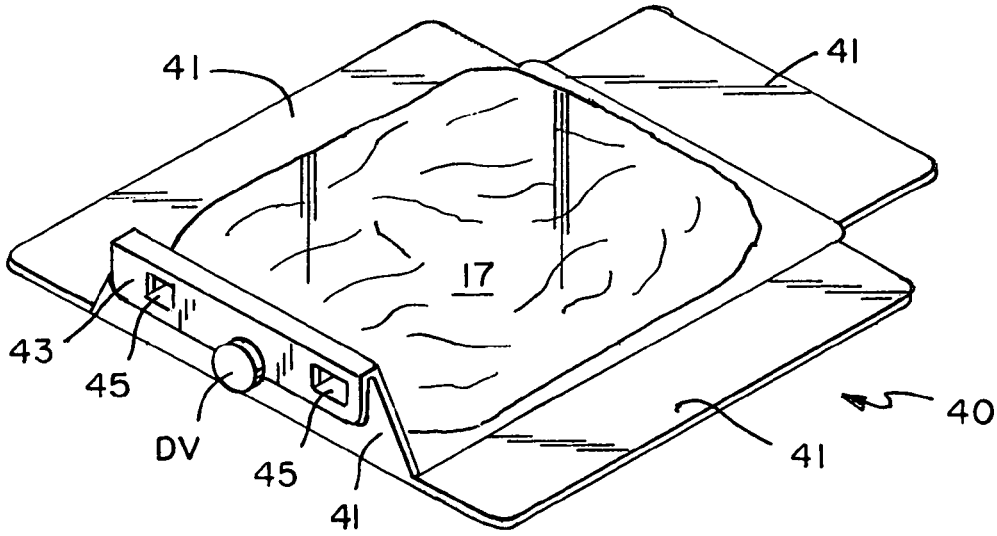
FIG. 20 is a top perspective view of the bag cassette and bag of FIG. 19 after the cassette end wall has been folded and attached to the dispensing valve.
Figure 21:
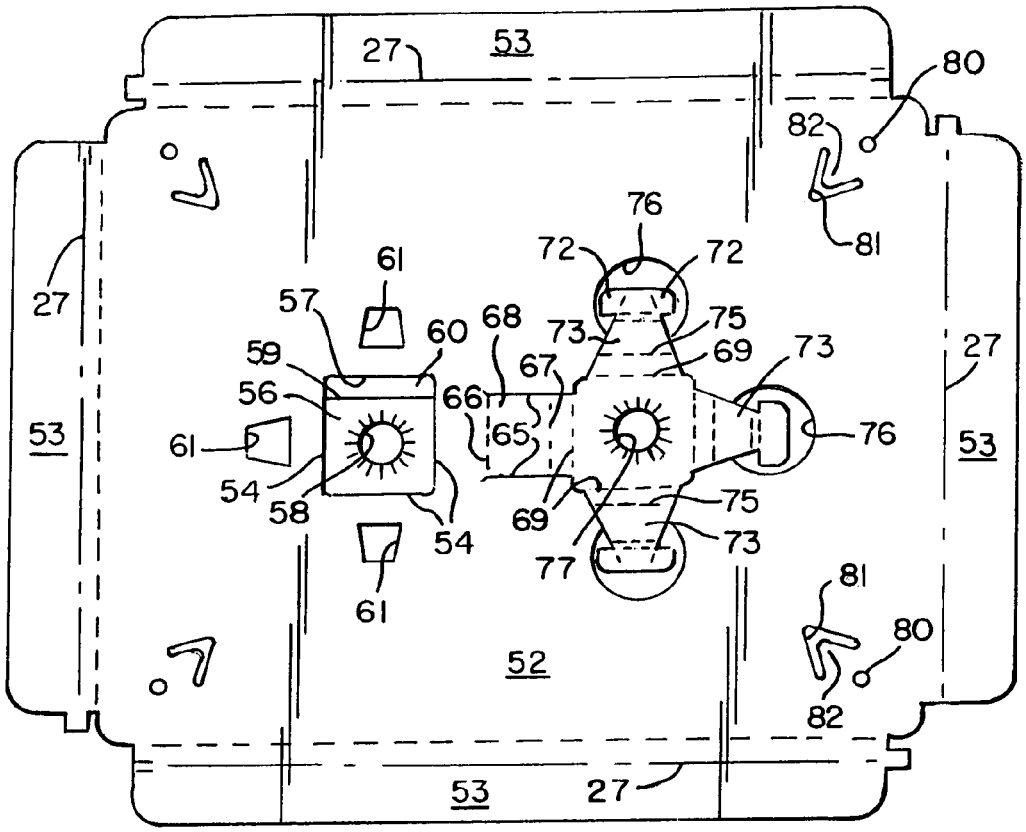
FIG. 21 is a plan view of a blank for forming the inner top cap or fill valve support plate in the preferred form of the invention.
Figure 22:
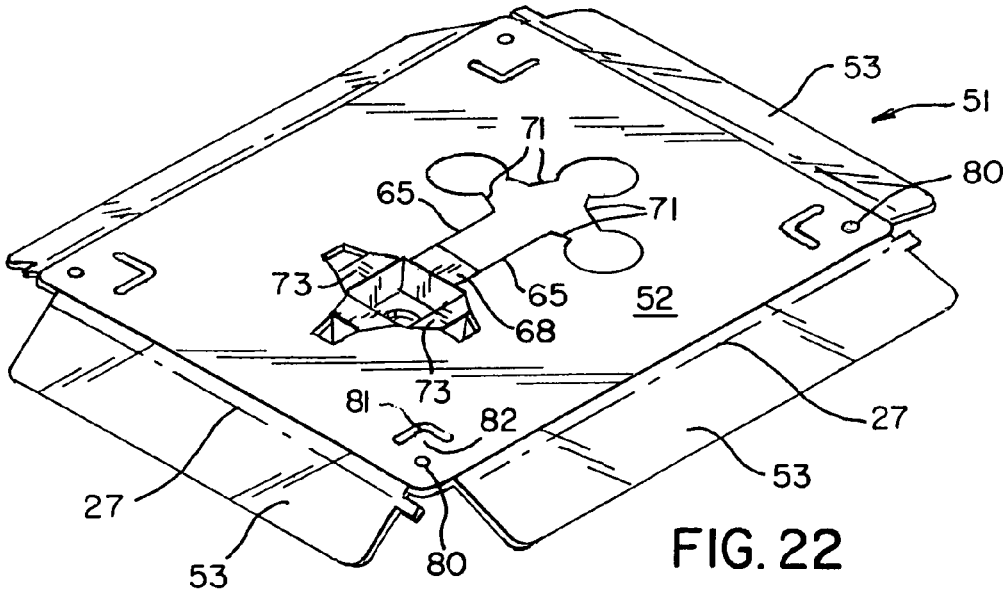
FIG. 22 is a top perspective view of the preferred form of fill valve support plate erected from the blank of FIG. 21.
Figure 23:
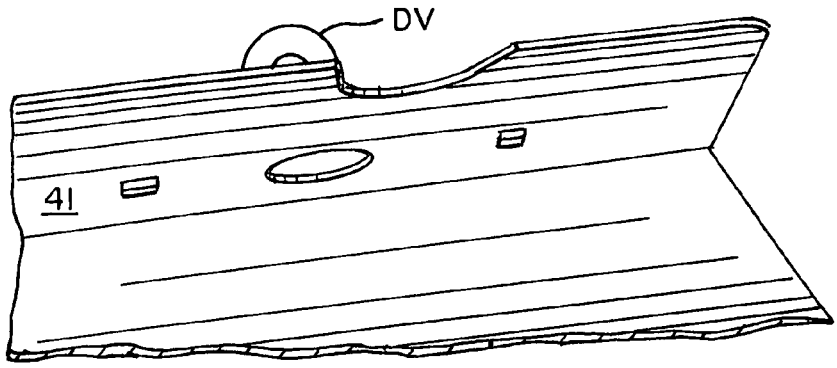
FIGS. 23-27 are enlarged fragmentary top perspective views showing various steps in folding and attaching the cassette end wall to the dispensing valve.
Figure 24:
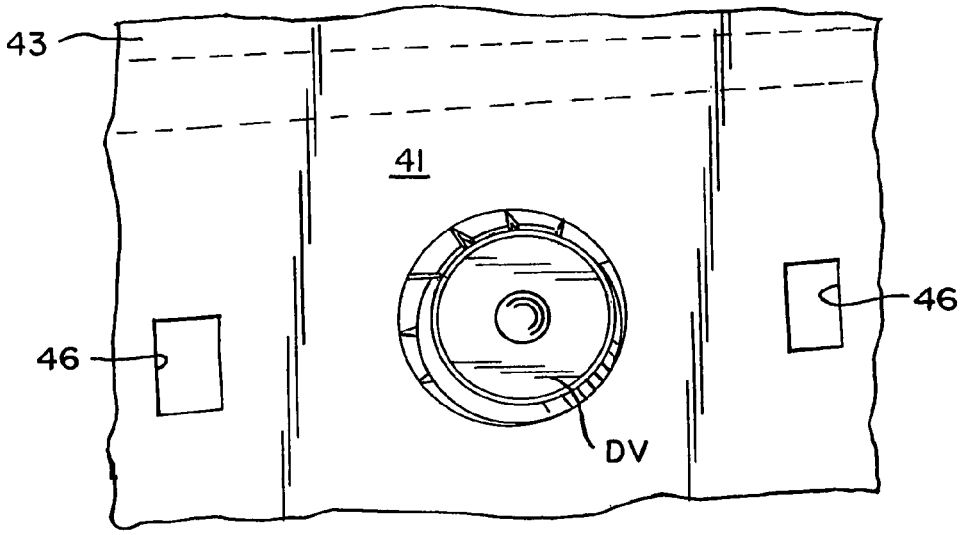
Figure 25:
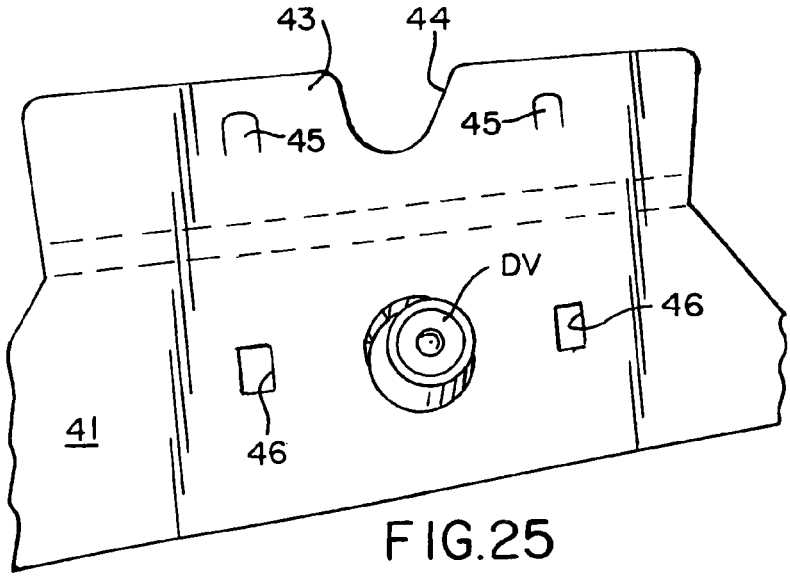
Figure 26:
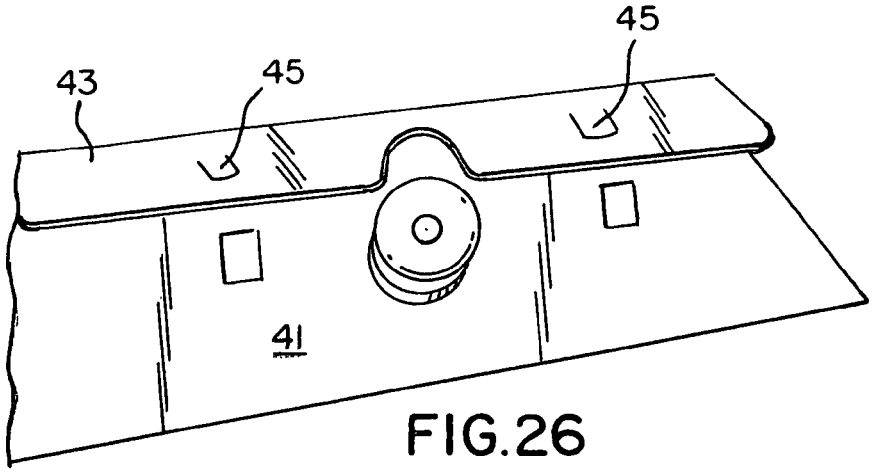
Figure 27:
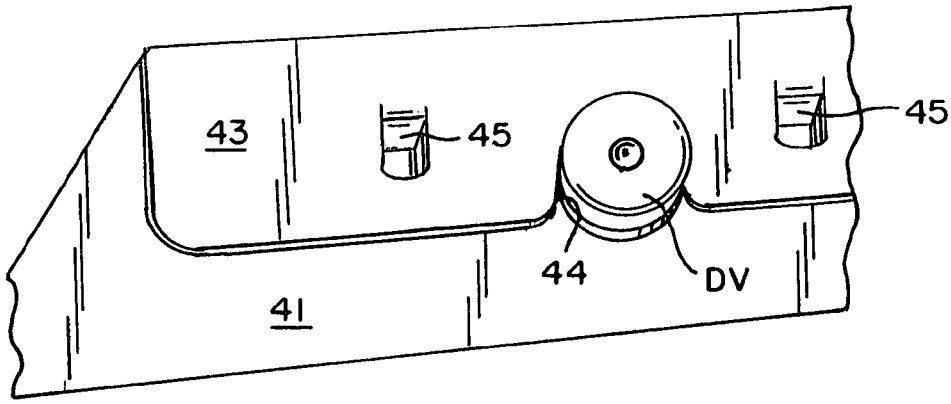
Figure 28:
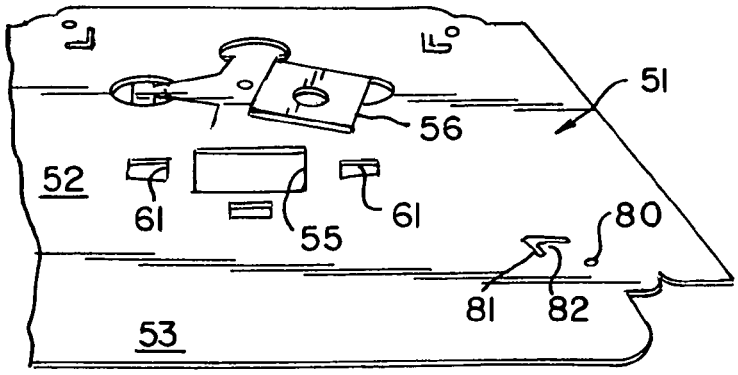
FIGS. 28-33 are enlarged fragmentary top perspective views showing various steps in folding and forming the fill valve support plate from the blank of FIG. 21.
Figure 29:
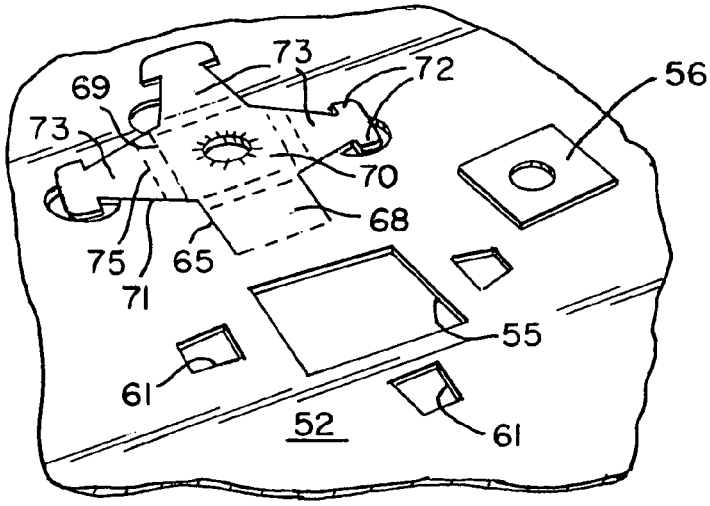
Figure 30:
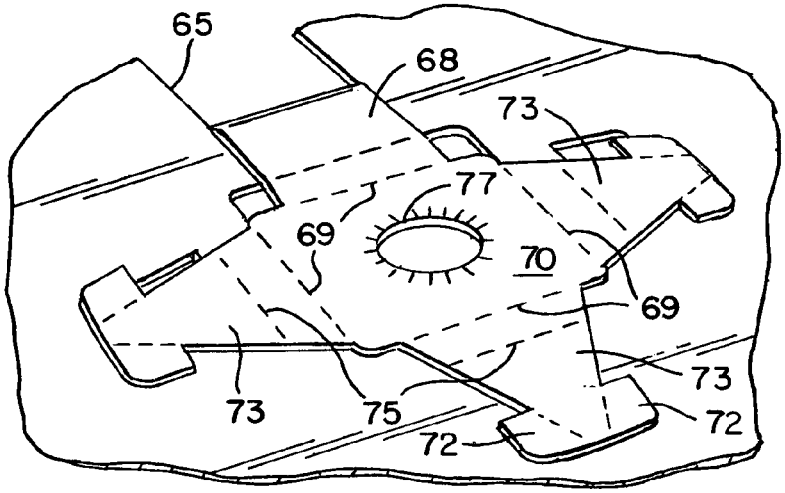
Figure 31:
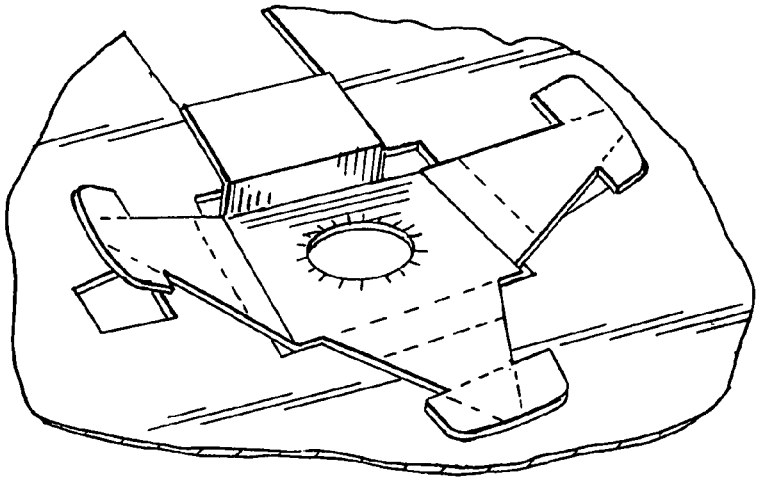
Figure 32:
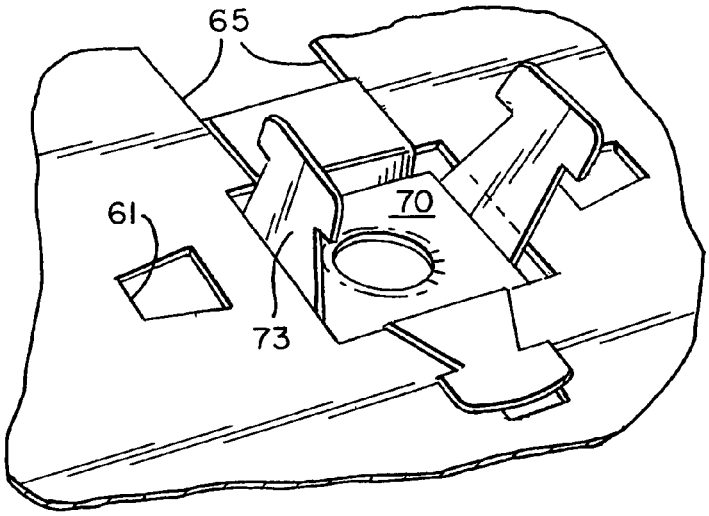
Figure 33:
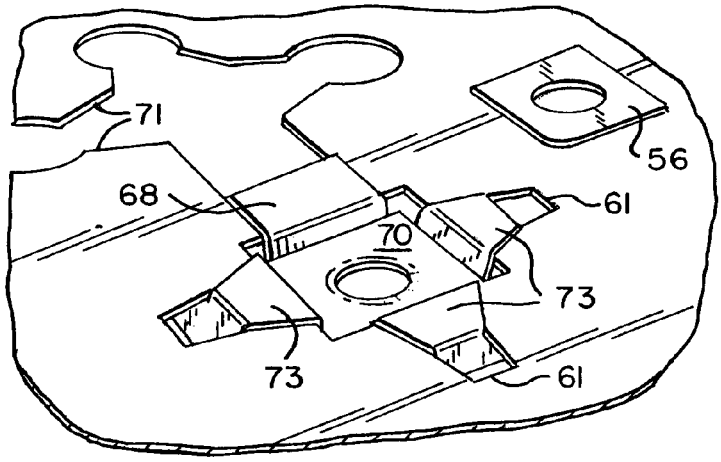
Figure 34:
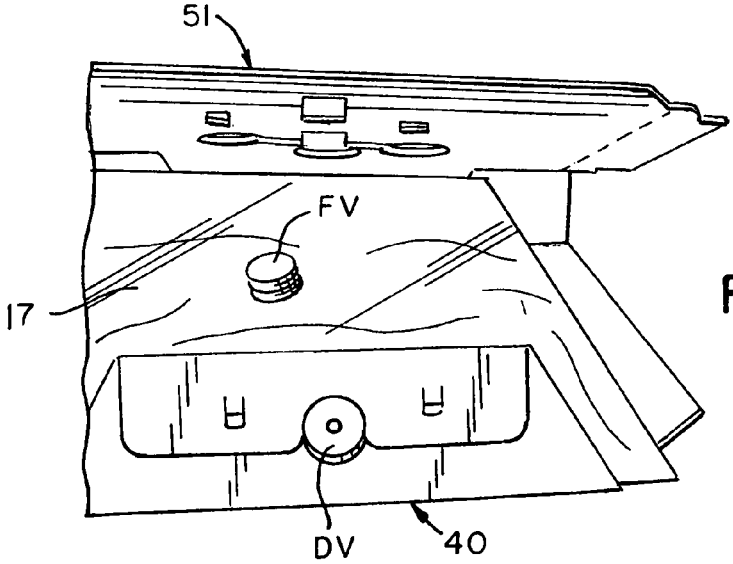
FIGS. 34-37 are enlarged fragmentary top perspective views showing various steps in assembling the fill valve support plate to the fill valve on the bag to complete the bag assembly.
Figure 35:
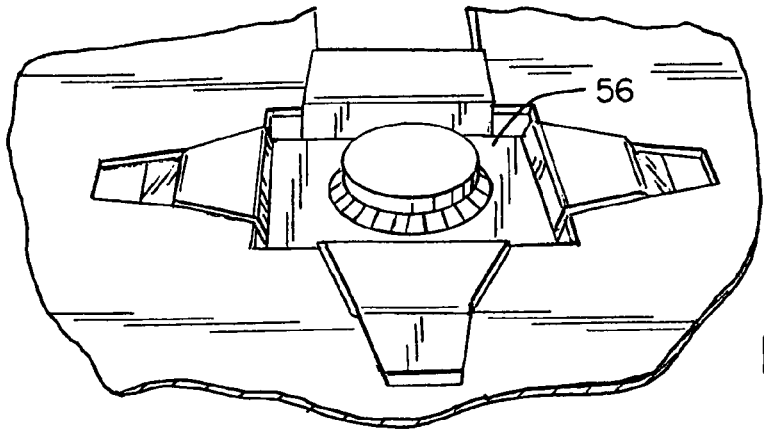
Figure 36:
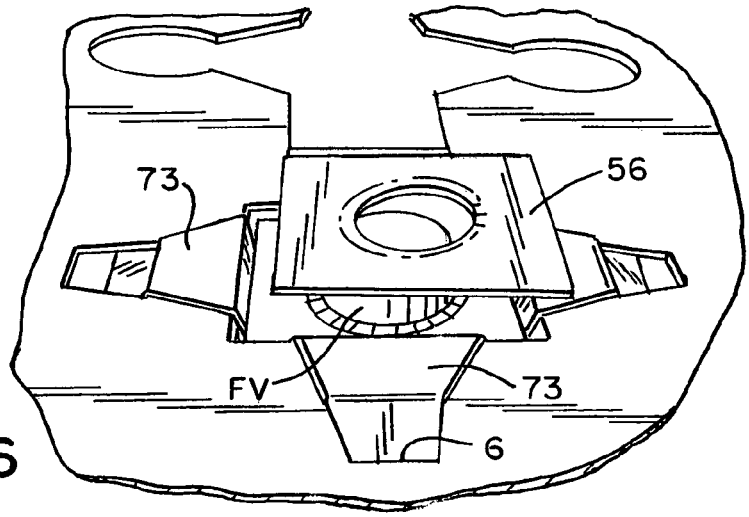
Figure 37:
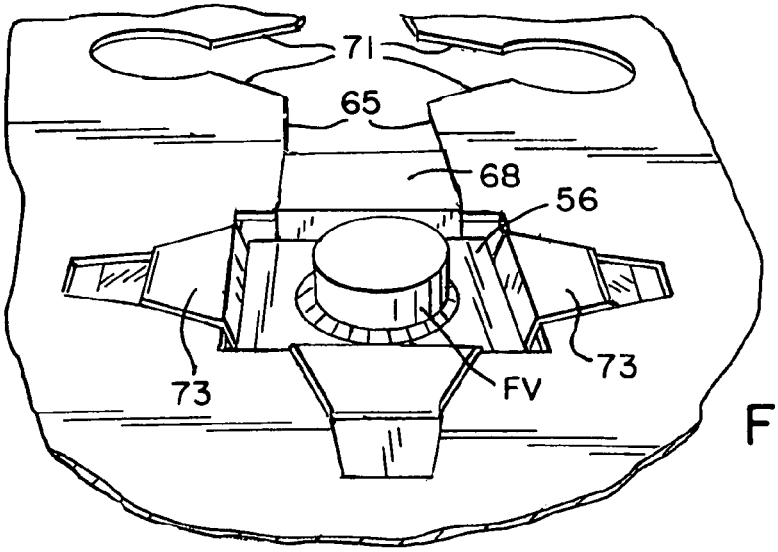

A first embodiment of corrugated container according to the invention is indicated generally at 10 in FIGS. 1, 2 and 15. The container comprises an open-ended side wall tube 11 of triple wall laminated construction, having two length panels 12 and 13 and two width panels 14 and 15, that can be of varying length and widths. A dispensing valve hole 16 is cut into one width panel of the tube for receiving a dispensing valve attached to a bag 17 supported in the container. The triple wall tube provides vertical compression resistance for stacking strength, and improved bulge resistance to an internally positioned bag. Further bulge resistance may be achieved by adding one or more inserts 18 along the inside of the length and width panels. See FIGS. 7-9 and 15. The inserts may comprise single panels 20 (FIG. 7) fitted against the inside surface of one or more of the side walls, and preferably at least on the length panels, or L-shaped inserts 21 (FIG. 8) that fit against a length panel and wrap around the comer to fit against the adjacent width panel, or U-shaped inserts 22 (FIG. 9) that fit against a length or width panel and wrap around adjacent comers to fit against two adjacent panels.

The tube is fitted with top and bottom single wall caps 23 and 24, respectively, that cover the upper and lower open ends of the tube. At least the bottom cap 24 is laminated to the side walls of the tube by use of adhesive or double face tape between the inner surface of the cap flaps 25, 26 and the outer surface of the end of the tube, and serves the function of "squaring up" the tube. Thus, utilizing an interior cassette as a squaring device is not required. Affixed top and bottom caps also help to minimize bulge. Additionally, the top cap covers and protects the fill valve during shipment and handling.

The bottom cap 24 has tear tape strips 27 in the cap flaps 25, 26 adjacent their folded connection with the cap end wall 27, allowing for easy removal of the cap from the tube, when desired. Use of the tear tape to sever the bottom cap from the container facilitates separation of the container from the pallet when it is desired to dispose of or recycle the container after it has been emptied, enabling easy collapse and disposal of the container after use.

An inner top cap or fill valve support plate 30 secures and locates the fill valve of the interior bag along the top plane of the assembled container. This fill valve support plate has a filling hole 31 cut out of a region that is aligned with the location of the fill valve of the interior bag, and has a multiplicity of die cut flaps 32 that flank the filling hole. Each flap has a fastening hoop 33 that serves to secure the fill valve to the support plate, which in turn holds the interior bag in an upward, fillable position. This is achieved by first bending the die cut flaps 32 180 degrees toward the interior of the container. The filling valve is then inserted through the fastening hoops 33 and filling hole 31, slightly flexing the hoop along the hoop's ridged edges 34 as it passes through. The hoop then re-sizes along the back end of the filling valve, thereby holding it in place. This feature eliminates the need for the initial user to pull up the filling valve from the bottom of the assembled container, thereby dramatically increasing the ease and efficiency of filling operation. The fill valve support plate has depending flaps 35 that are secured to the adjacent end of the side wall tube when the container has been assembled, and cut outs 36 in the corners of the blank that forms the support plate result in the plate being secured to the side wall tube by only the flaps. The space formed by these cut outs also provides room for an end user to grip and pull the tear tape, thus disengaging the fill valve support plate from the container.

Figure 14:
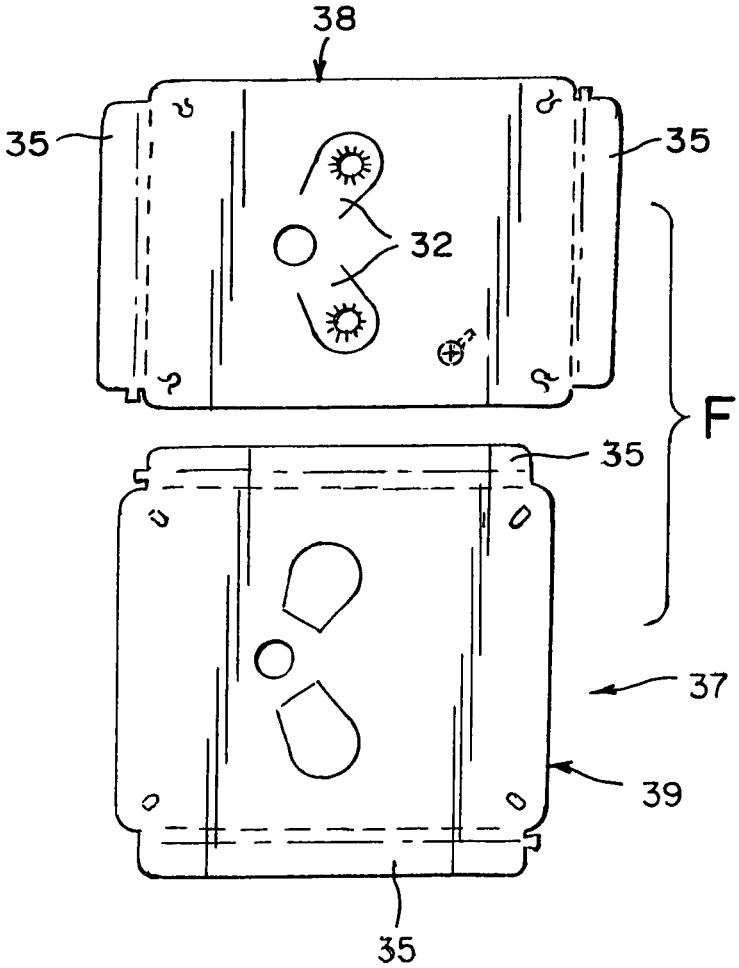
FIG. 14 is a plan view of a variation of the fill valve support plate shown in FIG. 13, wherein the plate is formed of two pieces laminated together, with attaching flaps on only two sides of each part, and the flaps on one part offset 90° from the flaps on the other part, thereby eliminating the need for auxiliary equipment to apply the tear tapes.

A variation of the fill valve support plate is indicated at 37 in FIG. 14, wherein the cassette is formed of two panels 38 and 39 each having only two flaps 35 on respective opposite side edges. The panels 38 and 39 are laminated together so that the flaps on one are on opposite sides of the laminated structure from the two flaps on the other panel, whereby the laminated structure has a flap on each of its four sides. It will be noted that one of the panels 38 carries the fill valve support flaps 32, and the other panel 39 has cut outs to accommodate the flaps 32. This arrangement eliminates the necessity to use auxiliary equipment to apply the tear tapes.

The end wall 27 of the bottom cap 24 is laminated or glued to a wooden pallet P prior to shipment to an initial user, such that the container and the pallet form a single structure. This also dramatically increases the ease of use by eliminating the need for the initial user to spend time and energy to physically strap the container to a wooden pallet. The smooth surface of the outer side of the bottom cap wall 27 makes attachment to the pallet possible.

Figure 4:
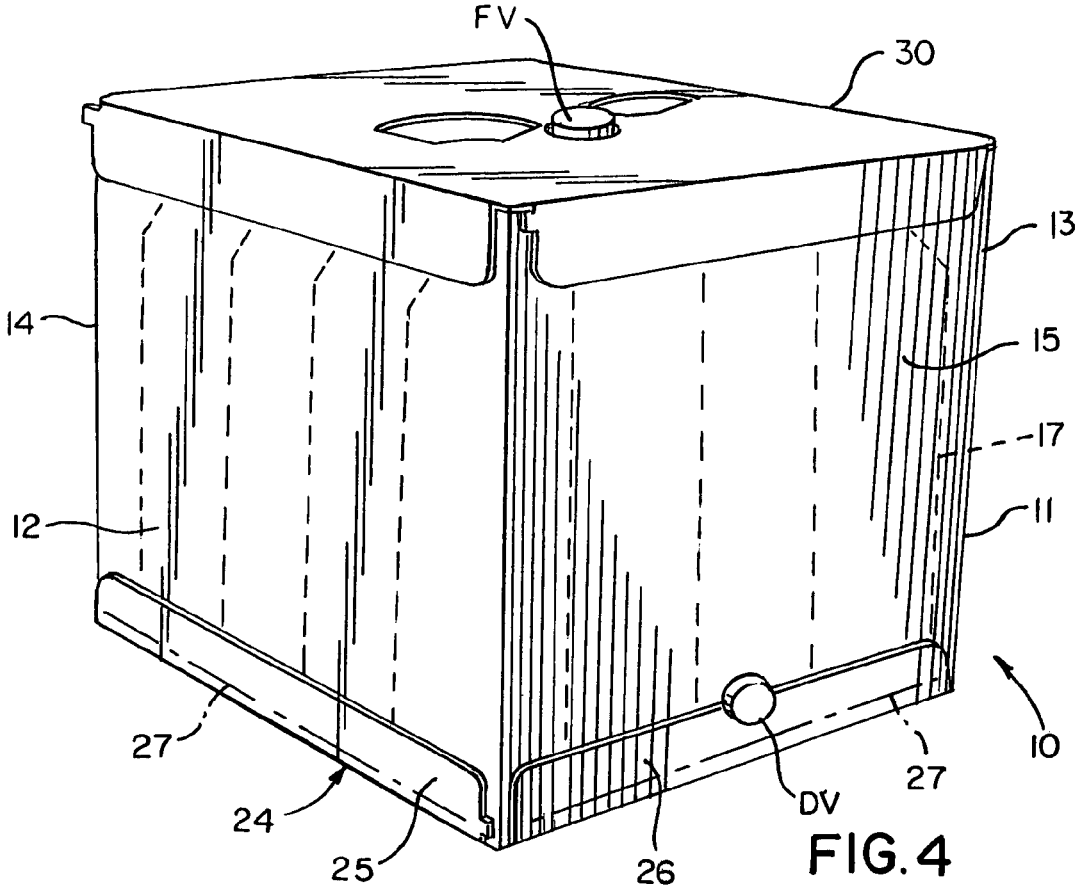
FIG. 4 is a schematic top perspective view of the container of FIGS. 1 and 2, showing in broken lines the general disposition of a bag in the container, prior to the bag being filled.
Figure 5:
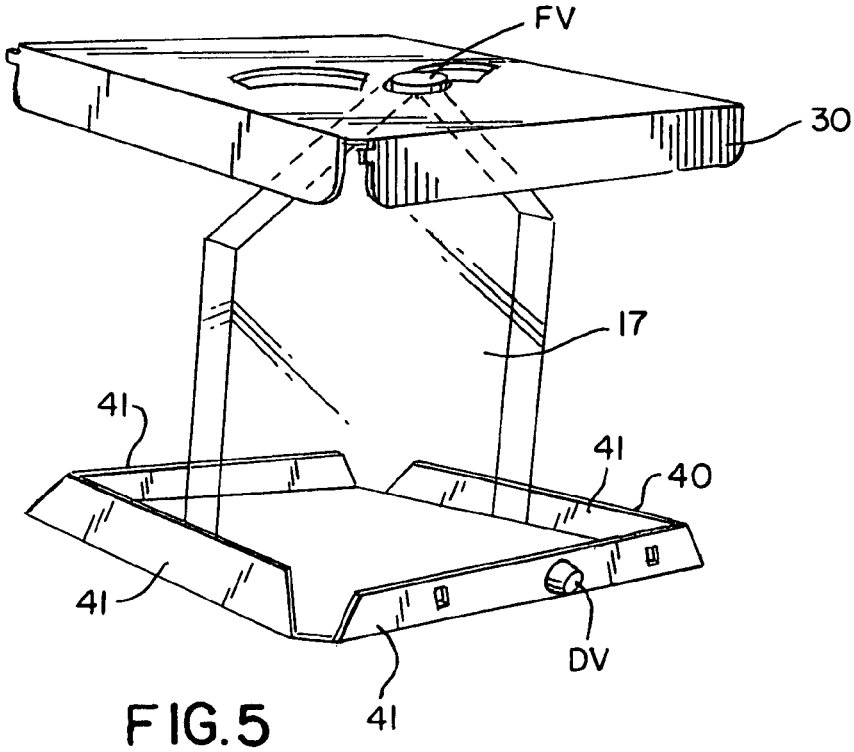
FIG. 5 is a top perspective view of the bag assembly used in the invention, comprising the bag cassette, the bag, and the inner top cap or fill valve support plate.

An exploded perspective view of the erected container's support structure is shown in FIGS. 4, 5 and 15. The flexible bag 17 is supported inside the tube 11 for containing liquids or semi-liquid fluids. The bag has a filling valve FV and a dispensing valve DV. These connect the interior of the bag to areas accessible by both initial and end user. The filling valve, used for filling of the bag with a liquid after the container is assembled, extends from the bag to the filling hole of the inner top cap or fill valve support plate. The dispensing valve extends through the dispensing valve hole in a lower area of one width panel for evacuation of liquid or semi-liquid from the flexible bag.

A bag cassette 40 positions the bottom of the bag within the bottom of the tube so that the dispensing valve of the bag is aligned with the dispensing valve hole on the outer tube and further provides additional support for the dispensing valve when the bag is filled. The cassette has a flap 41 on each of its four side edges, which slide into the side wall tube in close fitting relationship. One flap has a hole 42 therein for receiving the dispensing valve attached to the bag, and a locking panel 43 with a semi-circular recess 44 in its outer edge is foldably connected to the outer edge of this flap. After the dispensing valve is inserted through the hole 42, the panel 43 is folded over against the flap with the recess engaged against the dispensing valve, and locked in this position by inserting locking tabs 45 on the locking panel through aligned openings 46 in the flap. This arrangement securely holds the dispensing valve in the proper position to extend through the dispensing valve hole in the outer tube. The bag cassette also provides additional reinforcement in the bottom of the tube for support where most of the weight of the bag is concentrated.

Further, double sided tape, pressure sensitive adhesive, or like material may be placed on the inside of the outer top cap to releasably attach it to the fill valve support plate prior to shipment, thus acting as a tamper evident seal.

A preferred embodiment of container according to the invention is indicated generally at 50 in FIGS. 15-18 and 49. As in the previous embodiment, the container 50 comprises a side wall tube 11 formed by two triple wall blanks laminated together, with a top cap 23 and bottom cap 24. As before, the bottom cap is attached to a pallet P, and is laminated to the bottom end of the side wall tube by securing the flaps 25, 26 to the side wall by adhesive or double sided tape or the like. Tear strips 27 are provided in the flaps to enable the container to be separated from the bottom cap and pallet for easy collapse and disposal of the container. The bag 17 is attached at its lower end to a bag cassette 40 as in the previous embodiment.

The preferred embodiment 50 differs from the previous embodiment 10 primarily in the construction of the fill valve support plate 51. As seen best in FIGS. 17, 18, 21 and 22, the fill valve support plate 51 comprises a rectangular panel 52 having a flap 53 foldably connected to each side edge, as before, but the structure for holding and supporting the fill valve is substantially different and provides a much stronger arrangement. A first series of cuts 54 are made in the panel to define three sides of a rectangularly shaped area 55 that is located so that it will be centered on the fill valve when the fill valve support plate is in its operative position on the container. The cuts 54 do not completely separate the material bordered by the cuts from the surrounding panel, but define frangible score lines that can be torn to remove the panel 56 bordered by the cuts. The fourth side 57 of this area is defined by a cut that completely separates that edge of the panel 56 from the material of the surrounding panel. An opening 58 is formed in the removable panel 56 in a position to be aligned with and receive the fill valve. A series of radially oriented cuts are made in the panel 56 around the opening 58 to define bendable tabs that flex and lock behind the fill valve after it is inserted through the opening. It will be noted that one edge 59 of the panel is cut away, defining a space 60 to facilitate grasping of the panel when it is desired to remove it. Shaped openings 61 are formed through the panel 52 in outwardly spaced relationship to three sides of the rectangular area 55, for a purpose described below.

A pair of parallel cuts 65 spaced from that side of the area 55 not associated with a shaped opening 61 extend away from the area 55 and are spaced apart a distance less than the width of the area. A first fold score 66 extends between first ends of the cuts 65 closest to the area 55, and a second fold score 67 extends between the cuts 65 near but spaced from their opposite, second ends, defining a web 68.

Third fold scores 69 spaced outwardly from the fold score 67 define a rectangular panel 70 of approximately the same size and shape as the rectangular area 55, and having one side adjacent the web 68. Generally outwardly radiating convergent pairs of cuts 71 extend from the other three sides of the panel 70, terminating at their outer ends in laterally outwardly projecting bendable tabs 72. The cuts 71 define three orthogonally disposed arms 73 extending outwardly from three sides of the panel 70.

Fourth fold scores 75 extend across each arm spaced outwardly from the fold score 69 the same distance as the score 69 is spaced from the score 67, and circular cut outs 76 surround the outer end of each arm, defining spaces to facilitate grasping the arms as described below. A circular opening 77 is formed through the center of the panel 70, and a plurality of radial cuts 78 surrounding the opening form a plurality of bendable tabs 79.

Small openings 80 are formed through the plate 51 in each corner thereof, and chevron shaped slots 81 are formed in the plate spaced between the openings 80 and the center of the plate, to define arrow shaped tabs 82 pointing toward the center of the plate.

To erect the fill valve support plate, the removable panel 56 is separated from the panel 52 and laid to one side. The arms 73 are then grasped and lifted upwardly, pivoting the panel 70 and web 68 upwardly and then downwardly over the rectangular opening 55 formed by removal of the panel 56. The panel 70 is then pushed downwardly into the opening 55, causing the arms 73 to bend upwardly, and the web 68 to lie against the panel 52. The arms are then bent downwardly and their outer ends with the tabs 72 inserted through the shaped openings 61, with the tabs flexing through the openings and then springing out to lock the arms in their folded position. The panel 70 is then suspended by the arms in horizontal position recessed below the panel 52, in position to receive the fill valve.

Figure 38:
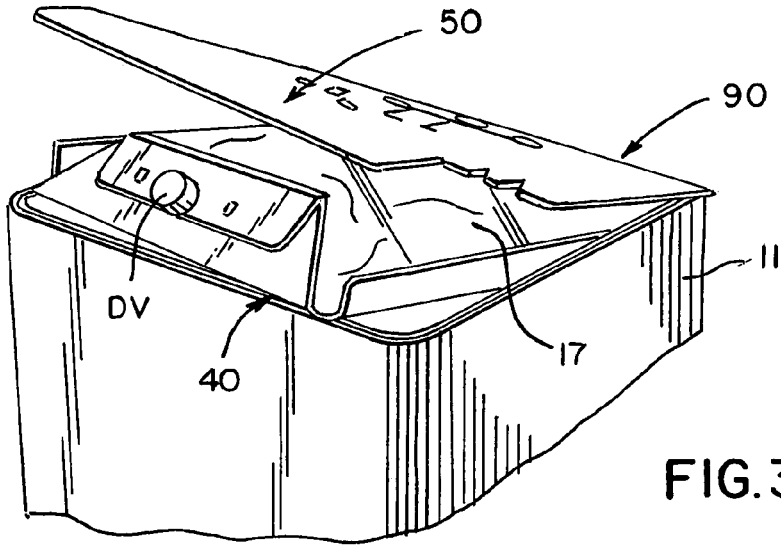
FIGS. 38-40 are fragmentary top perspective views showing various steps in placing the bag assembly in the container side wall tube.
Figure 39:
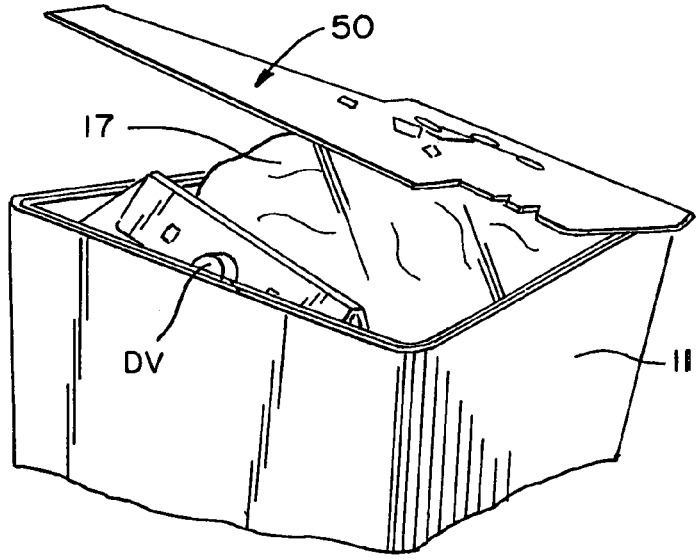
Figure 40:
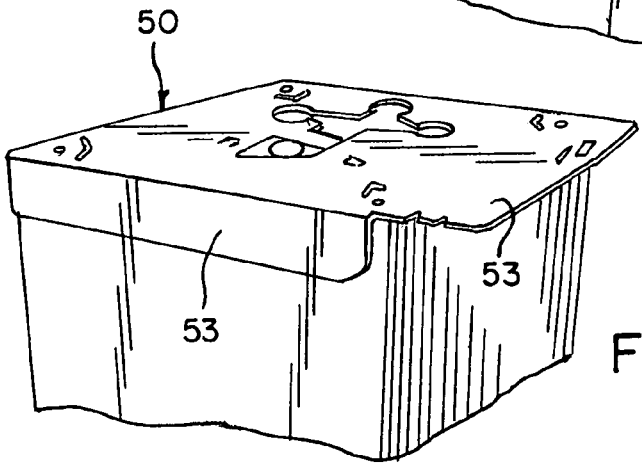
Figure 41:
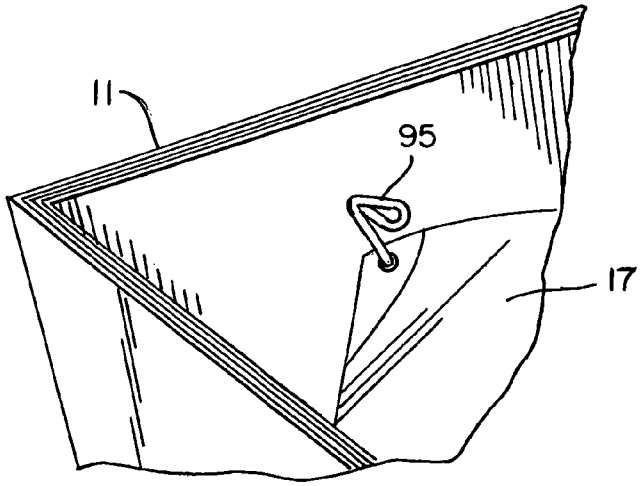
FIGS. 41-44 are enlarged fragmentary top perspective views showing various steps in connecting to the fill valve support plate the elastic bands that are attached to the bag.
Figure 42:
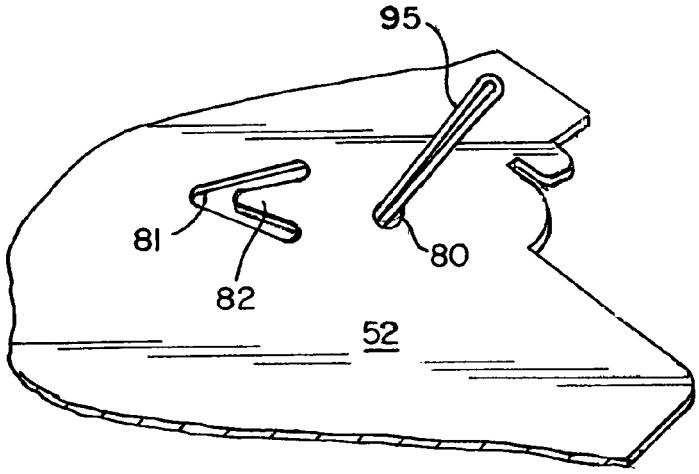
Figure 43:
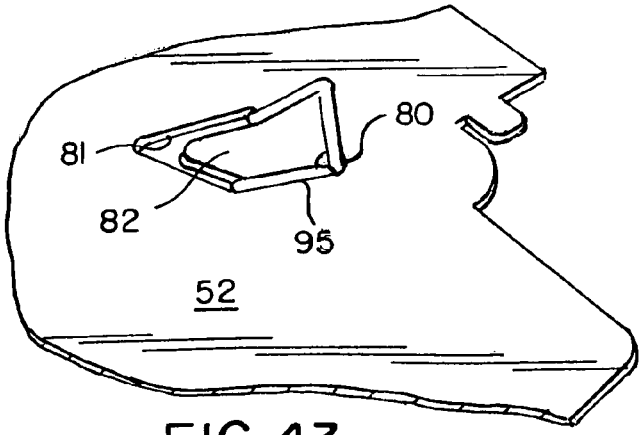
Figure 44:
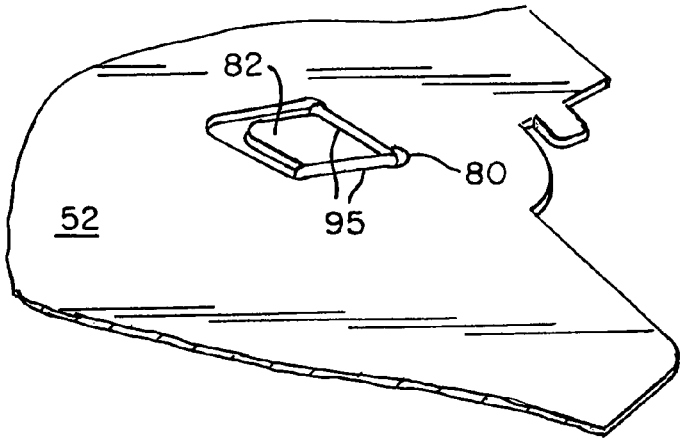
Figure 45:
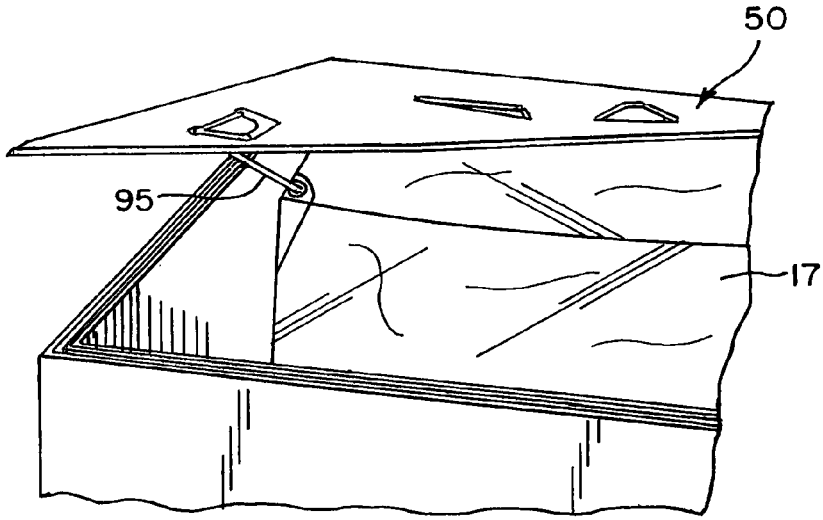
FIG. 45 is an enlarged fragmentary top perspective view of the container of FIG. 17, with the fill valve support plate partially raised to show the elastic band connected between the bag and the plate.
Figure 46:
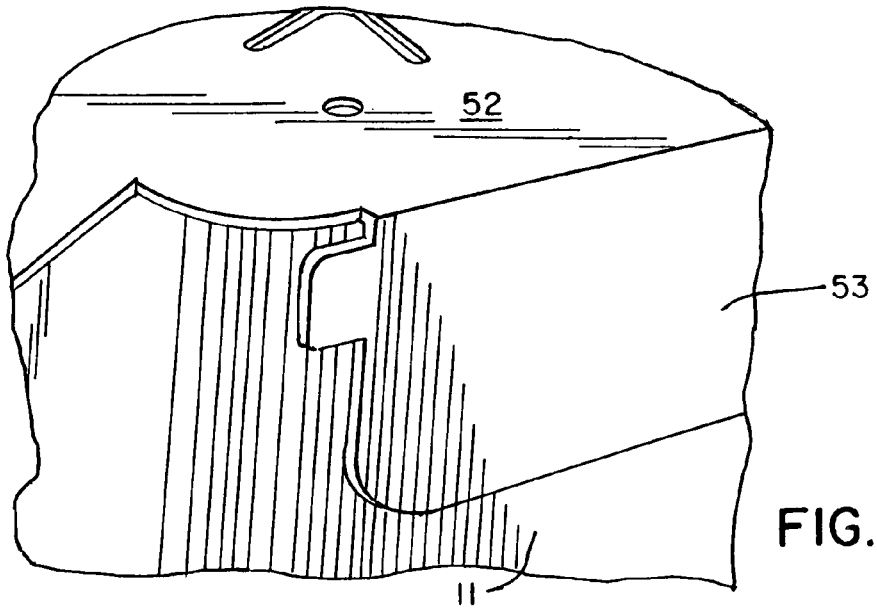
FIG. 46 is a further enlarged fragmentary top perspective view of one comer of the container of FIG. 45, showing the tear tab on the flaps, with one of the flaps folded into operative position and adhered or otherwise suitably affixed to the upper end of the container side wall.
Figure 47:
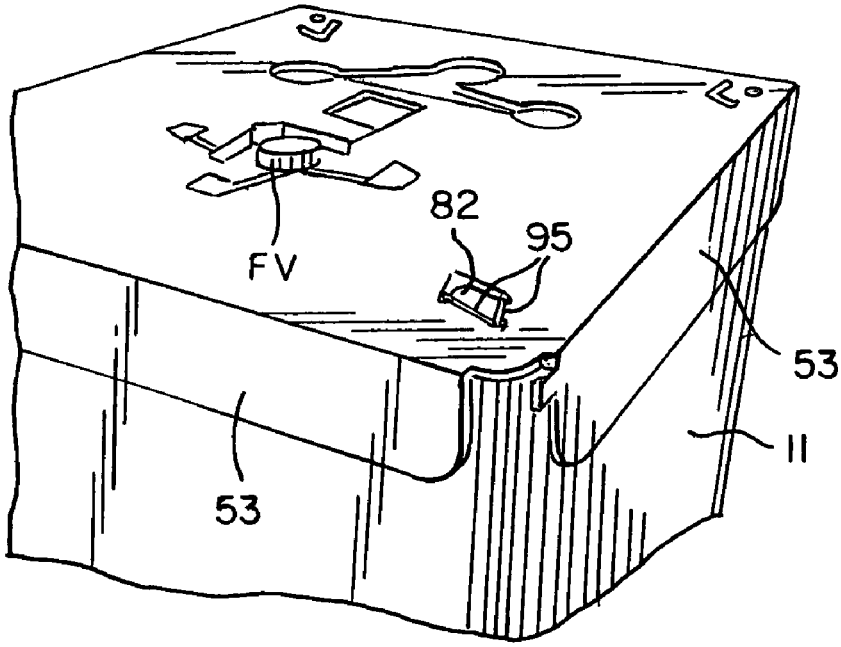
FIG. 47 is a fragmentary top perspective view of the container with the fill valve support plate in operative secured position on the upper end of the side wall tube.
Figure 48:
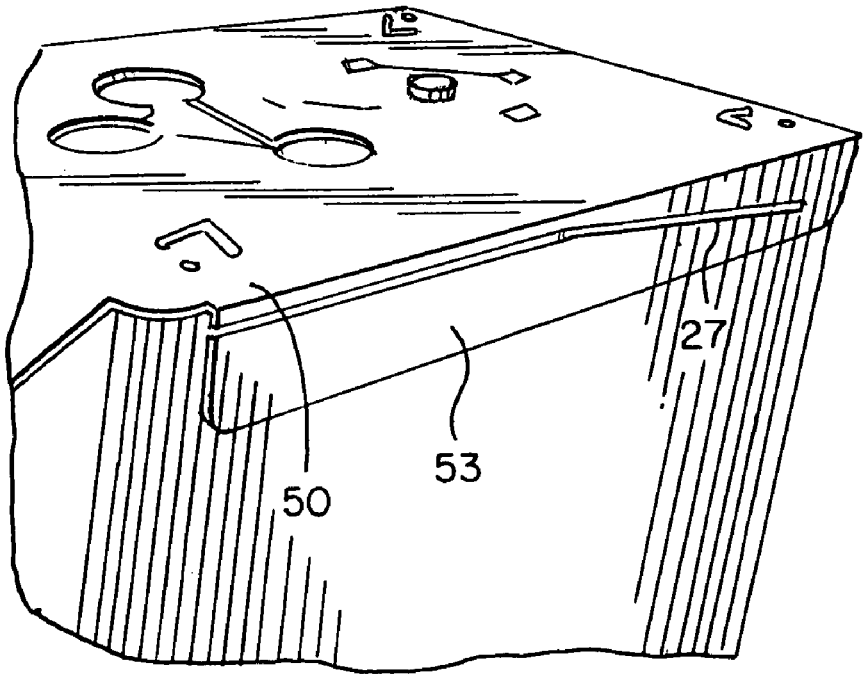
FIG. 48 is a fragmentary top perspective view of the container of FIG. 47, showing the tear tape being pulled to sever the flaps from the plate so that the plate and attached bag and bag cassette can be removed from the container.
Figure 49:
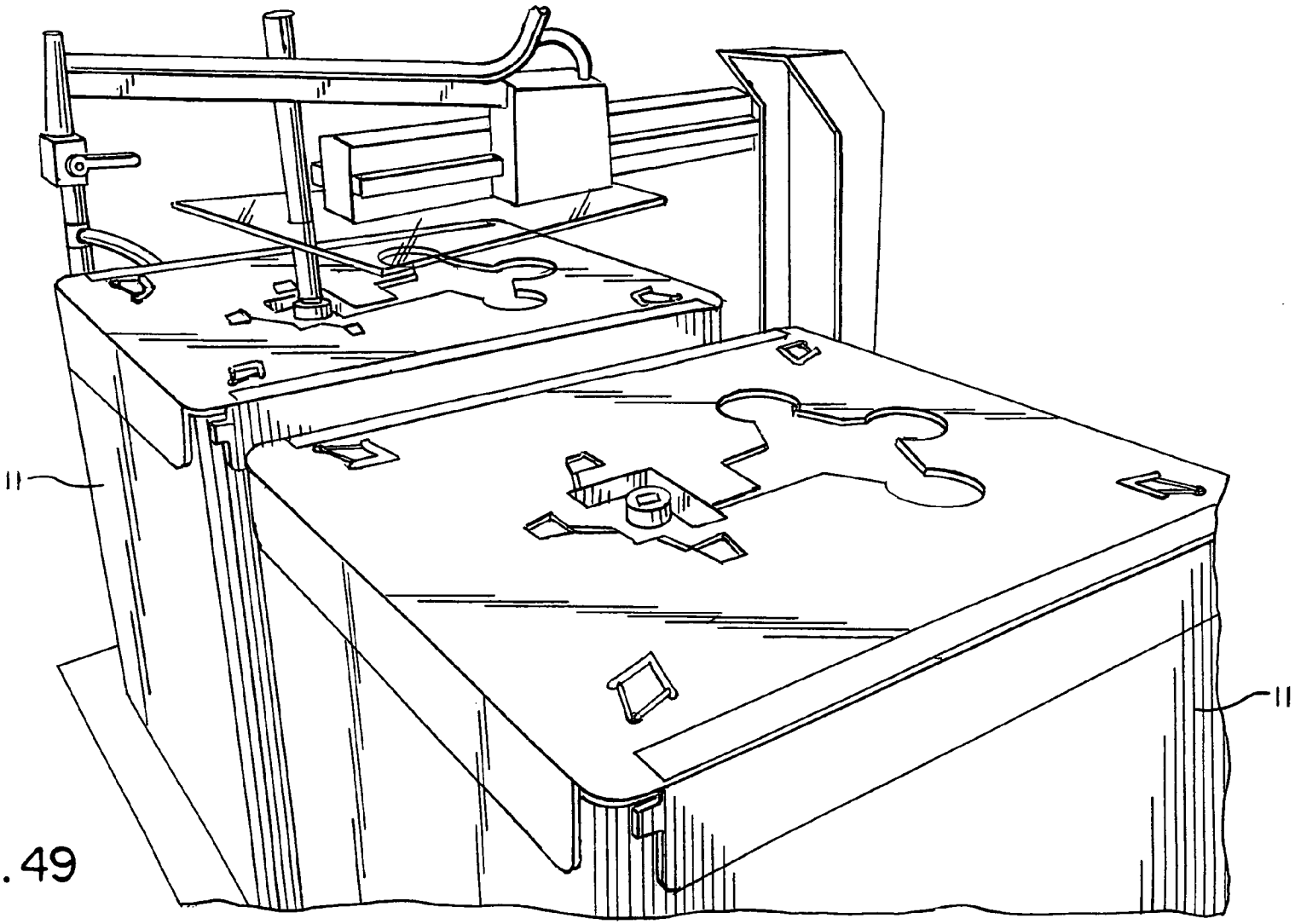
FIG. 49 is a fragmentary top perspective view showing a container according to the preferred embodiment being filled on an automated filling line, with another container waiting to be filled.

To complete assembly of a bag assembly 90 (FIGS. 18, 38 and 39), the fill valve support plate 51 is lifted and positioned over the previously assembled bag and bag cassette, and the fill valve attached to the bag is grasped and inserted through the opening 77 in panel 70, whereupon the tabs 79 flex to permit insertion of the fill valve through the opening, but engage behind the valve to prevent its withdrawal through the opening. The previously removed panel 56 is then placed down over the fill valve and lodged against the panel 70, with the outer edges of the panel 56 wedged between the arms to securely lock the fill valve support assembly in assembled relationship.

This arrangement provides a much stronger support for the fill valve than the previously described embodiment.

The preferred embodiment also utilizes elastic bands 95 connected between the bag and the fill valve support plate. As seen best in FIGS. 41-45, an elastic band 95 is attached at one end to the bag at areas corresponding to each comer of the container, and connected at their other end to the tabs 82 formed in the support plate 52. To attach the bands, after the bag assembly has been positioned on the container, with the bag cassette and the bag falling into the tube 11, the sides of the support plate are lifted up and the user reaches into the container to grasp the band. The free ends of the bands are then fed upwardly through the respective openings 80, and stretched over the tabs 82 formed by the chevron shaped slots 81. The bands help support the bag, and hold it in partially expanded position for receiving product during the filling operation.

After the bands are attached, the flaps 53 on the fill valve support plate are folded downwardly alongside the upper end of the tube 11, and attached thereto by use of double sided tape or pressure sensitive adhesive, or the like, thus securing the fill valve support plate and thus the bag assembly in place in the container.

Top cap 23 may then be placed on the upper end of the container to cover and protect the fill valve support plate and associated components. A pressure sensitive adhesive or double sided tape or the like may be placed between the top cap and the fill valve support plate to releasably attach these components together until it is desired to fill the container, at which time the top cap can be removed to gain access to the fill valve. This feature also provides a tamper evident seal.

Although particular embodiments of the invention are illustrated and described in detail herein, it is to be understood that various changes and modifications may be made to the invention without departing from the spirit and intent of the invention as defined by the scope of the appended claims.

What is claimed is:

1. A corrugated bulk container for shipping, storing and dispensing liquids and semi-liquid fluids, wherein the container has an interior bag for containing the liquid or semi-liquid fluid, comprising:

an open-ended tube having side walls and end walls of corrugated material; and a bag assembly supported in the tube, said bag assembly comprising the interior bag, a bag cassette to which a bottom end of the bag is attached, and a fill valve support plate to which a top end of the bag is attached, said bag cassette having means to receive and hold a dispensing valve attached to the bag, and the fill valve support plate having means to receive and support a fill valve attached to the bag; and wherein severable means comprising a tear strip configured on a plurality of flaps, the tear strip connecting said fill valve support plate to said tube so that the bag assembly can be easily removed from said tube to facilitate collapse and disposal or recycling of the container after said bag is emptied.

2. A bulk container as claimed in claim 1, wherein:

top and bottom end caps are on the ends of the tube to close the ends.

3. A bulk container as claimed in claim 2, wherein:

the bottom end cap is attached to a pallet, and the tube is connected to the bottom end cap, whereby the container is held assembled to the pallet without requiring the use of straps or other fasteners.

4. A bulk container as claimed in claim 3, wherein:

severable means connects the bottom end cap to the tube so that the container can be easily separated from the pallet to facilitate collapse and disposal of the container after it is emptied.

5. A bulk container as claimed in claim 1, wherein:

the bag cassette is slidably received in the tube, and the fill valve support plate is attached to an upper end of the tube.

6. A bulk container as claimed in claim 1, wherein:

attaching means connects the bag and the container to help support the bag in the container and help hold it in position to be filled.

7. The bulk container according to claim 6, wherein said attaching means are elastic bands connecting the bag and the container to help support the bag in the container and help hold it in position to be filled.

8. A bulk container as claimed in claim 1, wherein:

the bag cassette comprises a substantially flat panel to which the bag is attached, and foldable flanges connected to edges of the panel, one of said flanges having an opening therethrough for receiving the dispensing valve to hold and support it in alignment with a dispensing valve opening in the tube.

9. A bulk container as claimed in claim 1, wherein:

the fill valve support plate comprises a substantially flat panel having cuts forming a fill valve receiving and support means foldably attached to the panel.

10. A bulk container as claimed in claim 9, wherein:

the fill valve receiving and support means comprises a filling hole formed through the flat panel for receiving the fill valve, a multiplicity of foldable flaps flanking the filling hole, each flap having a fastening hoop through which the fill valve is inserted and that serves to secure the fill valve to the fill valve support plate, which in turn holds the bag in an upward, fillable position.

11. A bulk container as claimed in claim 10, wherein:

the flaps are die cut from the flat panel, and are bent 180 degrees from the plane of the panel and toward a central area of the panel, with the filling valve inserted through the filling hole and fastening hoops, slightly flexing the hoop as it passes through, and the hoop then re-sizing along a back end of the filling valve, thereby holding it in place.

12. A bulk container as claimed in claim 9, wherein:

the fill valve receiving and support means comprises a generally horizontal support panel suspended by support arms in a recessed position beneath the flat panel.

13. A bulk container as claimed in claim 12, wherein:

an opening is formed through the support panel, and the fill valve is received in the opening and supported by the support panel and support arms.

14. A bulk container as claimed in claim 13, wherein:

a separate locking panel is lodged against the support panel and wedged between the support arms, said locking panel having an opening through which the fill valve is received.

15. A bulk container as claimed in claim 13, wherein:

the support panel and support arms are formed by a first series of cuts made in the flat panel, the support panel and support arms being folded 180 degrees from the plane of the flat panel to a support position aligned with the fill valve.

16. A bulk container as claimed in claim 15, wherein:

a second series of cuts are made in the flat panel spaced from the first series of cuts, said second series of cuts forming an opening having a size and shape to receive the support panel therethrough.

17. A bulk container as claimed in claim 1, wherein:

the tube comprises two laminated layers of triple wall corrugated material.

18. A bulk container as claimed in claim 17, wherein:

insert panels are disposed inside the tube and against at least one of the side and end walls to reinforce the walls against outward bulging and to increase stacking strength of the container.

19. The bulk container as claimed in claim 1, wherein:

said severable means comprises at least one pair of flaps, each flap connected to opposite edges of said fill valve support plate and positioned to secure said fill valve support plate to an upper portion of said tube.

20. The bulk container as claimed in claim 19, wherein:

said severable means further comprises at least one member selected from the group consisting of a score line, perforated line, and tear tape positioned between each opposite edge of said fill valve support plate and said flap to which each opposite edge is attached.

21. A corrugated bulk container for shipping, storing and dispensing liquids and semi-liquid fluids, wherein the container has an interior bag for containing the liquid or semi-liquid fluid, comprising:

an open-ended tube having side walls and end walls of corrugated material; and a bag assembly supported in the tube, said bag assembly comprising the bag, a bag cassette to which a bottom end of the bag is attached, and a fill valve support plate to which a top end of the bag is attached, said fill valve support plate comprising a tear strip configured on a plurality of flaps, said bag cassette having means to receive and hold a dispensing valve attached to the bag, and the fill valve support plate having means to receive and support a fill valve attached to the bag, wherein in addition to said means of said fill valve support plate to receive and support said fill valve, at least one attaching means connects the bag to the container to help support the bag in the container and help hold it in position to be filled.

22. The bulk container as claimed in claim 21, wherein said at least one attaching means is at least one elastic band connecting the bag to the container to help support the bag in the container and help hold it in position to be filled.

23. The bulk container as claimed in claim 21, wherein said at least one attaching means connects said bag to said fill valve support plate of said container.

24. The bulk container as claimed in claim 23, wherein said fill valve support plate further comprises at least one tab positioned to engage said at least one attaching means.

25. The bulk container as claimed in claim 24, wherein said at least one tab is arrow shaped.

26. The bulk container as claimed in claim 24, wherein said at least one tab is formed by at least one chevron shaped slot in said fill valve support plate.

27. The bulk container as claimed in claim 24, wherein said fill valve support plate further comprises at least one opening positioned such that said at least one attaching means is first fed though said at least one opening prior to engaging said at least one attaching means with said at least one tab.

28. The bulk container as claimed in claim 27, wherein said at least one attaching means is at least one elastic band connecting the bag to the container to help support the bag in the container and help hold it in position to be filled.

29. The bulk container as claimed in claim 23, wherein said at least one attaching means is at least one elastic band connecting the bag to the container to help support the bag in the container and help hold it in position to be filled.

30. The bulk container as claimed in claim 23, wherein said fill valve support plate further comprises at least one tab positioned to engage said at least one attaching means extending from said bag.

31. The bulk container as claimed in claim 30, wherein said at least one tab is arrow shaped.

32. The bulk container as claimed in claim 30, wherein said at least one tab is formed by at least one chevron shaped slot in said fill valve support plate.

33. The bulk container as claimed in claim 30, wherein said fill valve support plate further comprises at least one opening positioned such that said at least one attaching means is first fed though said at least one opening prior to engaging said at least one attaching means with said at least one tab.

34. The bulk container as claimed in claim 33, wherein said at least one attaching means is at least one elastic band connecting the bag to the container to help support the bag in the container and help hold it in position to be filled.

35. The bulk container as claimed in claim 21, wherein said container has a plurality of corners and each of said at least one attaching means connects said bag to a position that is proximate to each of said plurality of corners of said container.

36. The bulk container as claimed in claim 35 wherein said container comprises at least four corners.

37. The bulk container as claimed in claim 35, wherein said at least one attaching means is at least one elastic band connecting the bag to the container to help support the bag in the container and help hold it in position to be filled.

38. The bulk container as claims in claim 37, wherein said fill valve support plate comprises at least four corners.

39. The bulk container as claimed in claim 21, wherein said fill valve support plate of said container has a plurality of corners and each of said at least one attaching means connects said bag to a position that is proximate to each of said plurality of corners of said fill valve support plate.

40. The bulk container as claimed in claim 39, wherein said at least one attaching means is at least one elastic band connecting the bag to the container to help support the bag in the container and help hold it in position to be filled.

* * * * *

UNITED STATES PATENT AND TRADEMARK OFFICE

CERTIFICATE OF CORRECTION

PATENT NO. : 7,607,564 B2
APPLICATION NO. : 10/867570
DATED : October 27, 2009
INVENTOR(S) : Michael Churvis et al.

It is certified that error appears in the above-identified patent and that said Letters Patent is hereby corrected as shown below:

Column 1 lines 4-5, should be corrected as follows:

This application claims the benefit of U.S. provisional patent application Ser. No. 60/492,524, filed Aug. 5, 2003.

Signed and Sealed this

Thirtieth Day of March, 2010

David J. Kappos

David J. Kappos
*Director of the United States Patent and Trademark Office*